US008345514B2

(12) United States Patent
Sumida et al.

(10) Patent No.: US 8,345,514 B2
(45) Date of Patent: Jan. 1, 2013

(54) RADIO-CONTROLLED TIMEPIECE AND METHOD OF ASSEMBLING THE SAME

(75) Inventors: Tatsuo Sumida, Iruma (JP); Kazuo Sakamoto, Tokorozawa (JP); Tadashi Yasuoka, Arakawa-ku (JP)

(73) Assignee: Citizen Holdings Co., Ltd., Tokyo (JP)

( * ) Notice: Subject to any disclaimer, the term of this patent is extended or adjusted under 35 U.S.C. 154(b) by 665 days.

(21) Appl. No.: 12/449,544

(22) PCT Filed: Mar. 5, 2008

(86) PCT No.: PCT/JP2008/053926

§ 371 (c)(1),
(2), (4) Date: Aug. 13, 2009

(87) PCT Pub. No.: WO2008/108394

PCT Pub. Date: Sep. 12, 2008

(65) Prior Publication Data

US 2010/0097895 A1 Apr. 22, 2010

(30) Foreign Application Priority Data

Mar. 5, 2007 (JP) ..... 2007-053758

(51) Int. Cl.
*G04C 11/02* (2006.01)

(52) U.S. Cl. ..... 368/47; 368/293

(58) Field of Classification Search ..... 368/47, 368/293

See application file for complete search history.

(56) References Cited

U.S. PATENT DOCUMENTS 5,511,679 A * 4/1996 Beck ..... 220/270

(Continued)

FOREIGN PATENT DOCUMENTS

EP 1 455 249 9/2004

(Continued)

OTHER PUBLICATIONS

Supplementary European Search Report issued Nov. 22, 2010 in corresponding European Patent Application No. EP 08 72 1346.

(Continued)

*Primary Examiner* — Sean Kayes

(74) *Attorney, Agent, or Firm* — Wenderoth, Lind & Ponack, L.L.P.

(57) ABSTRACT

A radio-controlled timepiece in which its reception sensitivity is further enhanced. The radio-controlled timepiece includes: an antenna core 11 made of a magnetic material and formed as a single integrated body including a coiled portion (11*a*) wound with a coil 19 and extension portions 11*b* and 11*c* which are located respectively on the end-portion sides; additional cores 15 and 16 made of a magnetic material; magnetism-collection members 17 and 18 made of a magnetic material; a main plate 31 (timepiece substrate) made of a non-magnetic material; a guide member 33 made of a non-magnetic material; and a liquid-crystal-panel supporting frame 32 (magnetism-collection-member supporting members, pressing member) made of a non-magnetic material and having protrusions 32*a* and 32*b* (pressing members) formed thereon. When the main plate 31, the guide member 33, and the liquid-crystal-panel supporting frame 32 are assembled together, the protrusions 32*a* and 32*b* press the magnetism-collection members, respectively. Thus, the magnetism-collection members 17 and 18 come into contact respectively with the additional cores 15 and 16, and, at the same time, the additional cores 15 and 16 come into contact respectively with the extension portions 11*b* and 11*c* of the antenna core 11. Accordingly an antenna-core body with a large single body is formed, which enhances the reception performance.

20 Claims, 14 Drawing Sheets

U.S. PATENT DOCUMENTS

| | | | | |
|---|---|---|---|---|
| 7,396,155 | B2 * | 7/2008 | Oguchi | 368/298 |
| 7,701,806 | B2 * | 4/2010 | Oguchi et al. | 368/47 |
| 7,724,199 | B2 * | 5/2010 | Someya et al. | 343/788 |
| 7,777,680 | B2 * | 8/2010 | Abe et al. | 343/718 |
| 8,040,284 | B2 * | 10/2011 | Teng et al. | 343/702 |
| 2003/0117900 | A1 * | 6/2003 | Fujisawa et al. | 368/47 |
| 2004/0233789 | A1 | 11/2004 | Oguchi et al. | |
| 2006/0066498 | A1 | 3/2006 | Abe et al. | |
| 2006/0114162 | A1 * | 6/2006 | Minami et al. | 343/718 |
| 2006/0214866 | A1 | 9/2006 | Araki et al. | |
| 2006/0291334 | A1 * | 12/2006 | Heck | 368/47 |
| 2007/0120758 | A1 | 5/2007 | Takahashi | |

FOREIGN PATENT DOCUMENTS

| | | |
|---|---|---|
| EP | 1 689 029 | 8/2006 |
| EP | 1 693 924 | 8/2006 |
| JP | 2004-125606 | 4/2004 |
| JP | 2004-235701 | 8/2004 |
| JP | 2004-354365 | 12/2004 |
| JP | 2006-153752 | 6/2006 |
| JP | 2006-333183 | 12/2006 |
| JP | 2006-343240 | 12/2006 |
| JP | 2007-184894 | 7/2007 |

OTHER PUBLICATIONS

International Search Report issued Apr. 8, 2008 in the International (PCT) Application of which the present application is the U.S. National Stage.

* cited by examiner

RADIO-CONTROLLED TIMEPIECE AND METHOD OF ASSEMBLING THE SAME

TECHNICAL FIELD

The present invention relates to a radio-controlled timepiece and a method of assembling the same, and more specifically, to an improved built-in antenna to receive the standard signal.

BACKGROUND ART

A radio-controlled timepiece receives a standard signal including time information and date information, and then, on the basis of the information included in this standard signal, driving means such as a motor forcefully displaces the time-indicating hands such as the hour hand, the minute hand, and the sweep hand, so that the time-indicating hands indicate the correct time corresponding to the information included in the standard signal.

Carrying out time-calibrating operation in this way at least once a day enables the radio-controlled timepiece to always show the correct time.

Meanwhile, each radio-controlled timepiece has an antenna built therein for receiving the standard signal. At the early stage of development, the radio-controlled timepiece used to have a case made, at least partially, of resin so as to allow its antenna to be more sensitive to radio waves.

The appearance of a case made of resin is, however, less attractive than that of a case made of metal. For this reason, many recent radio-controlled timepieces have employed metal as a material for their cases.

An antenna is less sensitive to signals when built in a metal case than when built in a resin case. Thus, various improvements have been made in an antenna itself to increase the reception sensitivity.

For example, a technique to improve the reception sensitivity is proposed (see Patent Document 1). In the technique, an antenna core includes: a coiled portion that is wound with a coil; and extending portions that protrude respectively towards their corresponding end portions of the antenna core. The extending portions are bent towards the windshield glass which allows the standard signals to pass therethrough relatively easily.

In addition, another technique to improve the reception sensitivity is proposed (see Patent Document 2). In the technique, an antenna core includes: a coiled portion that is wound with a coil; and extending portions located respectively on the end portions of the antenna core, and respectively connected to radio-wave acquisition portions each of which is larger in size than the corresponding portion.

Patent Document 1: JP-A-2006-153752

Patent Document 2: JP-A-2004-235701

It is difficult, however, to bend the antenna core because the antenna core is made of a brittle material, such as an amorphous material. Even if the antenna core is formed as a laminate of plural thin plates as disclosed in Patent Document 1, this antenna core, however, can be successfully bent without breakage only by an extremely small curvature. For this reason, it is difficult to greatly improve the reception sensitivity.

It is true, on the other hand, that providing radio-wave acquisition portions that are larger in size than the extension portions of the antenna core can enhance the reception sensitivity as shown in Patent Document 2. However, the accomplished enhancement in the reception sensitivity is not significant, because the antenna core and the radio-wave acquisition portions are placed within a single plane. Therefore, there still remains a demand for further enhancement in the reception sensitivity.

Simply increasing the size of radio-wave acquisition portions causes various problems. For example, the placement of the antenna is restricted within a limited space in the timepiece case. If the radio-wave acquisition portions are disposed too close to the timepiece case made of metal, a loss is caused by an eddy current. A contact of the radio-wave acquisition portions with the metal case causes an eddy current to flow through the metal case. In addition, the larger radio-wave acquisition portions also result in less efficient use of space to accommodate the antenna in the case.

The present invention made in view of the foregoing circumstances aims to provide a radio-controlled timepiece capable of further enhancing the reception sensitivity and to provide a method of assembling the same.

SUMMARY OF THE INVENTION

The radio-controlled timepiece and its assembling method according to the present invention achieve a greater enhancement in reception sensitivity by providing additional cores that are formed as separate bodies from the antenna core. The additional cores are placed so as to rise up in the thickness direction of the timepiece and to be in contact respectively with the extension portions of the antenna core. Providing the additional cores has the same effects as those obtainable when the end portions of the antenna core are expanded by the same size as that of the additional cores. The end portions (additional cores) of the antenna core, which can be considered as being extended, rise up in the thickness direction of the timepiece by a larger amount than in the conventional timepieces in which the end portions of the integrated antenna core are bent. The additional cores, which expand three-dimensionally, can be formed larger in size than the additional cores which are simply increased in size within a single plane, within the same, limited space in the timepiece case.

A radio-controlled timepiece according to the present invention comprises: an antenna core made of a magnetic material and formed as a single integrated body including a coiled portion wound with a coil and an extension portion that is located closer to an end portion than the coiled portion is; an additional core made of a magnetic material; a timepiece substrate made of a non-magnetic material; a guide member made of a non-magnetic material; and a pressing member made of a non-magnetic material. The timepiece substrate includes an antenna supporting portion that supports the antenna core substantially within a plane of the timepiece substrate. The guide member includes an additional-core supporting portion that supports the additional core so that the additional core rises up in the thickness direction of the timepiece. The pressing member biases the additional core towards the extension portion of the antenna core so that one end face of the additional core comes into contact with the extension portion of the antenna core.

Here, the antenna core has a shape having a longer side extending in a particular direction, such as a bar-like shape, a rectangular-like shape, or the like. The central portion or the vicinity of the central portion is wound with a coil, and the portion wound with the coil is referred to as a coiled portion whereas the portion protruding out from the coil is referred to as an extension portion. The distinction of these portions is made for reasons of convenience. The coiled portion and the extension portion do not have to differ from each other in materials or in profile shapes, but may differ from each other in these points.

Note that the extension portion does not exclusively mean the end portion of the antenna core, but may be any portion as long as protruding out from the coil as described above.

The additional cores are magnetically connected to the antenna core so as to together form a functionally-integrated antenna core (the single body formed by integrating the two bodies together will be sometimes referred to as an antenna-core body below). Accordingly, it is preferable that these two bodies be made of the same material, which makes these members easily form a single body in terms of the physical properties. Nevertheless, the use of the same material is not compulsory.

According to the thus-formed radio-controlled timepiece of the present invention, the additional core, which is formed as a member independent of the antenna core, comes into contact with the antenna core. Thus, obtained is the effect which is similar to that obtainable by expanding the end portion of the antenna core by the amount of the additional core. Specifically, the effect is that the reception performance can be enhanced.

In addition, the antenna core and the additional core are formed as members separated from one another before being assembled together. Accordingly, changing, in various ways, a contact angle made by these cores, contact positions of these cores, and the like allows the shape of the integrated antenna-core body to be formed freely. Consequently, the degree of freedom for the external shape of the antenna-core (body) can be higher than that in the conventional case where the antenna-core body is formed into a desired shape by bending the antenna core that has been originally provided as a single, integrated body.

Accordingly, by bringing the additional core into contact with the antenna core so that the additional core can rise up in the thickness direction of the timepiece, the antenna-core body, as a single entity, can be formed so as to have a three-dimensionally expanding shape. This antenna-core body can further enhance the reception sensitivity compared to that obtainable in the case where only an antenna core is simply increased in size within a single plane. Even within the limited space of the case of the timepiece, the degree of freedom for the placement of the antenna is higher than those in conventional cases.

In addition, the antenna core is supported by antenna supporting portion of the timepiece substrate (e.g., main plate) substantially within the plane of the timepiece substrate. The additional core is supported by the additional-core supporting portion of the guide member in such a way as to rise up in the thickness direction of the timepiece. Then the timepiece substrate and the guide member are assembled together. The pressing member biases the additional core so as to bring the one end face of the additional core into contact with the extension portion of the antenna core. Accordingly, assembling the components into the antenna-core body is easier than in the case where the components are assembled into the antenna-core body without the timepiece substrate or the additional-core supporting member.

In the radio-controlled timepiece of the present invention, it is preferable that the pressing member include a lower pressing member located on the antenna-core side and an upper pressing member located on the additional-core sides.

According to the radio-controlled timepiece with such a configuration, the contact between the antenna core and the additional core becomes favorable, and a magnetic circuit can be formed without failure.

The radio-controlled timepiece according to the present invention preferably further comprises: a magnetism-collection member made of a magnetic material; and a magnetism-collection-member supporting member that supports the magnetism-collection member. The magnetism-collection-member supporting member supports the magnetism-collection member so that the magnetism-collection member is positioned between the pressing member and the other end face of the additional core and is in contact with the other end face of the additional core.

According to this preferable radio-wave timepiece, the magnetism-collection member is formed as a part of the antenna-core body and is thus integrated into the antenna-core body. Accordingly, a larger antenna-core body can be formed.

Moreover, the magnetism-collection member is supported by the magnetism-collection-member supporting member. This makes it easier to attach the magnetism-collection member to the additional core than in the case where the assembling work has to be done without any support.

In the radio-controlled timepiece of the present invention, the magnetism-collection-member supporting member is preferably formed integrally with the pressing member. A protrusion for pressing is preferably formed, as the pressing member, on the magnetism-collection-member supporting member.

According to the radio-controlled timepiece with such a configuration, simply forming the protrusion for pressing on the magnetism-collection-member supporting member allows the protrusion to function as the pressing member. Accordingly, an increase in the number of components can be prevented.

In the radio-controlled timepiece of the present invention, the extension portions are preferably formed respectively on the two end-portion sides of the antenna core. In addition, it is preferable that the additional cores be biased respectively towards and be thus in contact respectively with the extension portions that are formed respectively on the two end portions of the antenna core.

In the radio-controlled timepiece of the present invention, only one additional core is sufficient in a functional point of view. However, according to a preferable radio-controlled timepiece, in which two extension portions are formed in the antenna core, two additional cores can be made to correspond respectively to the two extension portions so that the reception of the standard signal can be balanced appropriately.

In the radio-controlled timepiece of the present invention, at least the antenna core is preferably made of an amorphous material.

Being a brittle material, an amorphous material has difficulty in being bent due to its physical properties. For this reason, the effects of the radio-controlled timepiece of the present invention can be relatively enhanced.

Note that the rising direction in which the additional core rises up from the extension portion of the antenna core is preferably a direction such that the additional core can approach the windshield glass of the timepiece.

It is likely that the antenna most easily receives the standard signal at the leading-end portion of the additional core (or, the magnetism-correction member in a radio-controlled timepiece that has the magnetism-correction member added thereto). According to the preferable radio-controlled timepiece, the standard signal that enters through the windshield glass can be received more easily.

Accordingly, even if the case, the back lid, and other portions of the timepiece, except for the windshield glass are made of a metal to improve the external appearance, the antenna can be prevented from having a less performance to receive the standard signal.

Note that the guide member may be formed as a part of the timepiece substrate.

It is preferable that the radio-controlled timepiece of the present invention further comprises an antimagnetic plate that is disposed in a space formed between the antenna core and the magnetism-collection member in the thickness direction and that blocks or reduces the influence of an external magnetic field on a motor and the like.

In the radio-controlled timepiece with such a configuration, the antimagnetic plate that prevents or reduces the influence of an external magnetic field on a motor and the like is disposed in a space formed between the antenna core and the magnetism-collection member (the space formed in the thickness direction). Accordingly, the performance of the magnetism-collection member to receive the standard signal is not lowered down, by the influence of the antimagnetic plate. In addition, the motor and the like are disposed more closely to the lower surface (i.e., back-lid side) than the antimagnetic plate is. Accordingly, the influence of the external magnetic field on the motor and the like can be prevented effectively.

In the radio-controlled timepiece according to the present invention, it is preferable that the magnetism-collection member is laid at least partially over the antimagnetic plate when viewed from above.

In the radio-controlled timepiece with such a configuration, the magnetism-collection member is offset, in the thickness direction of the timepiece, from the antimagnetic plate. Accordingly, even if overlaid to each other when viewed from above, the magnetism-collection member and the antimagnetic plate are not adversely affected in their performances by each other. Moreover, the magnetism-collection member and the antimagnetic plate can have larger areas without causing interference on each other, so that the performance of the magnetism-collection member and the performance of the antimagnetic plate can both be enhanced.

In the radio-controlled timepiece of the present invention, it is preferable that the magnetism-collection members are disposed respectively at both ends of the antenna core, and at least a part of each of the magnetism-collection members is laid over the antimagnetic plate when viewed from above.

In the radio-controlled timepiece with such a configuration, each of the magnetism-collection members can be expanded from the corresponding one of the two end portions of the antenna core without causing the interference with the antimagnetic plate. Accordingly, the performances of the magnetism-collection members can both be further enhanced.

In the radio-controlled timepiece of the present invention, it is preferable that the antimagnetic plate at least include: a first antimagnetic plate, a part of which is laid over one of the magnetism-collection members when viewed from above; and a second antimagnetic plate, a part of which is laid over the other one of the magnetism-collection members when viewed from above. The first antimagnetic plate and the second antimagnetic plate are disposed so as to be magnetically separated from each other.

Note that the magnetic separation means a state, for example, where each one of the two members is not influenced by the magnetism of the other or where the influence of the magnetism is so small that the influence is negligible.

According to the radio-controlled timepiece with such a configuration, the separation of the antimagnetic plate (i.e., the separation achieved by disposing the first antimagnetic plate and the second antimagnetic plate so that the two antimagnetic plates can be magnetically separated from each other) can prevent the formation of a magnetic path starting from one of the two magnetism-collection members and reaching the other magnetism-collection member.

In addition, the separation of the antimagnetic plate (i.e., the separation achieved by disposing the first antimagnetic plate and the second antimagnetic plate so that the two antimagnetic plates can be magnetically separated from each other) can prevent the formation of a magnetic loop: one of the magnetism-collection members→one of the additional cores→antenna core→the other additional core→the other magnetism-collection member→the antimagnetic plate→the one magnetism-collection member.

The two-body structure of the antimagnetic plates does not cause the reception performance to be lowered by the magnetic loop or the like. In addition, the two-body structure of the antimagnetic plates allows both the areas of the magnetism-collection members and the areas of the separated antimagnetic plates to be widened. Accordingly, the performances of both the members and the plates can be enhanced.

It is preferable that the radio-controlled timepiece of the present invention further comprise a liquid-crystal-panel supporting frame that is made of a non-magnetic material and that supports a liquid crystal panel. The liquid-crystal-panel supporting frame preferably serves also as the pressing member.

According to the radio-controlled timepiece with the preferable configuration, the existing liquid-crystal-panel supporting frame serves also as the pressing member, so that it is not necessary to provide a pressing member that is separated from the liquid-crystal-panel supporting frame. Consequently, an increase in the manufacturing cost due to the increase in the number of components can be suppressed.

It is preferable that the radio-controlled timepiece of the present invention further comprise a calendar supporting frame to hold a calendar displaying member that is made of a non-magnetic material and that displays calendar information. The calendar supporting member preferably serves also as the pressing member.

According to the radio-controlled timepiece with the preferable configuration, the existing calendar supporting frame serves also as the pressing member, so that it is not necessary to provide a pressing member that is independent of the calendar supporting frame. Consequently, an increase in the manufacturing cost due to the increase in the number of components can be suppressed.

A method of assembling a radio-controlled timepiece according to the present invention comprises the following steps. At a step, an antenna supporting portion supports an antenna core substantially within a plane of a timepiece substrate. The antenna supporting portion is formed in the timepiece substrate made of a non-magnetic material. The antenna core is made of a magnetic material, and the antenna core is formed as a single integrated body including a coiled portion wound with a coil and an extension portion that is located closer to an end portion than the coiled portion is. At another step, an additional-core supporting portion formed in a guide member made of a non-magnetic material supports an additional core made of a magnetic material so that the additional core rises up in the thickness direction of the timepiece. At still another step, a pressing member made of a non-magnetic material biases the additional core towards the antenna core so that one end face of the additional core comes into contact with the extension portion of the antenna core.

According to the method of assembling a radio-controlled timepiece of the present invention with the above-described configuration, the additional core, which is formed as a member separately from the antenna core, comes into contact with the antenna core. Thus, obtained is the effect similar to that obtainable by expanding the end portion of the antenna core by the size of the additional core. Specifically, the effect is that the reception performance can be enhanced.

In addition, the antenna core and the additional core are formed as members that are separated from one another before being assembled together. Accordingly, changing, in various ways, a contact angle made by these cores, contact positions of these cores, and the like allows the shape of the integrated antenna-core body to be formed freely. Consequently, the degree of freedom for the external shape of the antenna-core (body) can be higher than that in the conventional case where the antenna-core body is formed by bending the antenna core that has been originally provided as a single, integrated body.

Accordingly, by bringing the additional core into contact with the antenna core so that the additional core can rise up in the thickness direction of the timepiece, the antenna-core body, as a single entity, can be formed so as to have a three-dimensionally expanding shape. This antenna-core body can further enhance the reception sensitivity compared to that obtainable in the case where antenna core is simply increased in size within a single plane. Concurrently, even within the limited space in the case of the timepiece, the degree of freedom for the placement of the antenna is higher than those in conventional cases.

In addition, the antenna core is supported by an antenna supporting portion of the timepiece substrate (e.g., main plate) substantially within the plane of the timepiece substrate. The additional core is supported by the additional-core supporting portion of the guide member in such a way as to rise up in the thickness direction of the timepiece. Then the timepiece substrate and the guide member are assembled together. The pressing member biases the additional core so as to bring the one end face of the additional core into contact with the extension portion of the antenna core. Accordingly, assembling the components into the antenna-core body is easier than in the case where the components are assembled into the antenna-core body without the timepiece substrate or the additional-core supporting member.

In the method of assembling a radio-controlled timepiece of the present invention, the pressing member preferably includes a lower pressing member located on the antenna-core side and an upper pressing member located on the additional-core side.

According to the method of assembling a radio-controlled timepiece with such a configuration, the contact between the antenna core and the additional core becomes favorable, and a magnetic circuit can be formed without failure.

It is preferable that the method of assembling a radio-controlled timepiece of the present invention further comprise the following steps. At a step, a magnetism-collection-member supporting member supports a magnetism-collection member made of a magnetic material. At a subsequent step, the magnetism-collection-member supporting member is set in such a position that the magnetism-collection member is positioned between the pressing member and the other end face of the additional core and is in contact with the other end face of the additional core.

According to the method of assembling a radio-controlled timepiece with such a configuration of the present invention, the magnetism-collection member constitutes a part of the antenna-core body and is integrated into the antenna-core body. Accordingly, a larger antenna-core body can be formed.

The fact that the magnetism-collection member is supported by the magnetism-collection-member supporting member makes it easier to attach the magnetism-collection member to the additional core than in the case where the assembling work has to be done without any help.

In the method of assembling a radio-controlled timepiece of the present invention, it is preferable that the magnetism-collection-member supporting member be formed integrally with the pressing members, and that a protrusion for pressing be formed, as the pressing member, on the magnetism-collection-member supporting member.

According to the method of assembling a radio-controlled timepiece with such a configuration, simply forming the protrusion for pressing on the magnetism-collection-member supporting member allows the protrusion to function as the pressing member. Accordingly, the increase in the number of components for the radio-controlled timepiece can be avoided, and the assembling work is made more easily.

In the method of assembling a radio-controlled timepiece of the present invention, it is preferable that the extension portions be formed respectively on the two end portions of the antenna core, and that the additional cores be biased respectively towards and are thus in contact respectively with the extension portions that are formed respectively on the two end portions of the antenna core.

According to the method of assembling a radio-controlled timepiece with such a configuration in which two extension portions are formed in the antenna core, two additional cores are made to correspond to the two extension portions. Thus, the reception of the standard signal can be balanced appropriately.

In the method of assembling a radio-controlled timepiece of the invention, at least the antenna core is made of an amorphous material.

Being a brittle material, an amorphous material has difficulty in being bent due to its physical properties. For this reason, the effects of the method of assembling a radio-controlled timepiece of the present invention can be relatively enhanced.

In the method of assembling a radio-controlled timepiece of the invention, it is preferable that the radio-controlled timepiece further include a liquid-crystal-panel supporting frame that is made of a non-magnetic material and that holds a liquid crystal panel, and that the liquid-crystal-panel supporting frame serve also as the pressing member.

According to the method of assembling a radio-controlled timepiece with the preferable configuration, the existing liquid-crystal-panel supporting frame serves also as the pressing member, so that it is not necessary to provide a new pressing member that is independent of the liquid-crystal-panel supporting frame. Consequently, an increase in the manufacturing cost due to the increase in the number of assembling processes associated with the increase in the number of components can lessen.

In the method of assembling a radio-controlled timepiece of the invention, it is preferable that the radio-controlled timepiece include a calendar supporting frame to hold a calendar displaying member that is made of a non-magnetic material and that displays calendar information, and that the calendar supporting frame serve also as the pressing member.

According to the method of assembling a radio-controlled timepiece with the preferable configuration, the existing calendar supporting frame serves also as the pressing member, so that it is not necessary to provide a new pressing member that is independent of the calendar supporting frame. Consequently, an increase in the manufacturing cost due to the increase in the number of assembling processes associated with the increase in the number of components can lessen.

Note that the rising direction in which the additional core rises up from the extension portion of the antenna core is preferably a direction such that the additional core can approach the windshield glass of the timepiece.

The antenna most easily receives the standard signal at the leading-end portion of the additional core (or, at the magnetism-correction member in a radio-controlled timepiece that has the magnetism-correction member added thereto). According to the preferable radio-controlled timepiece, the standard signal that enters through the windshield glass is received easily.

Accordingly, even if the case, the back lid, and other portions of the timepiece except for the windshield glass are made of a metal to improve the external appearance, the antenna can be prevented from having a less performance to receive the standard signal.

Effects of the Invention

According to the radio-controlled timepiece and the method of assembling a radio-controlled timepiece of the present invention, the reception sensitivity to the standard signal can further be enhanced.

Figure 6:
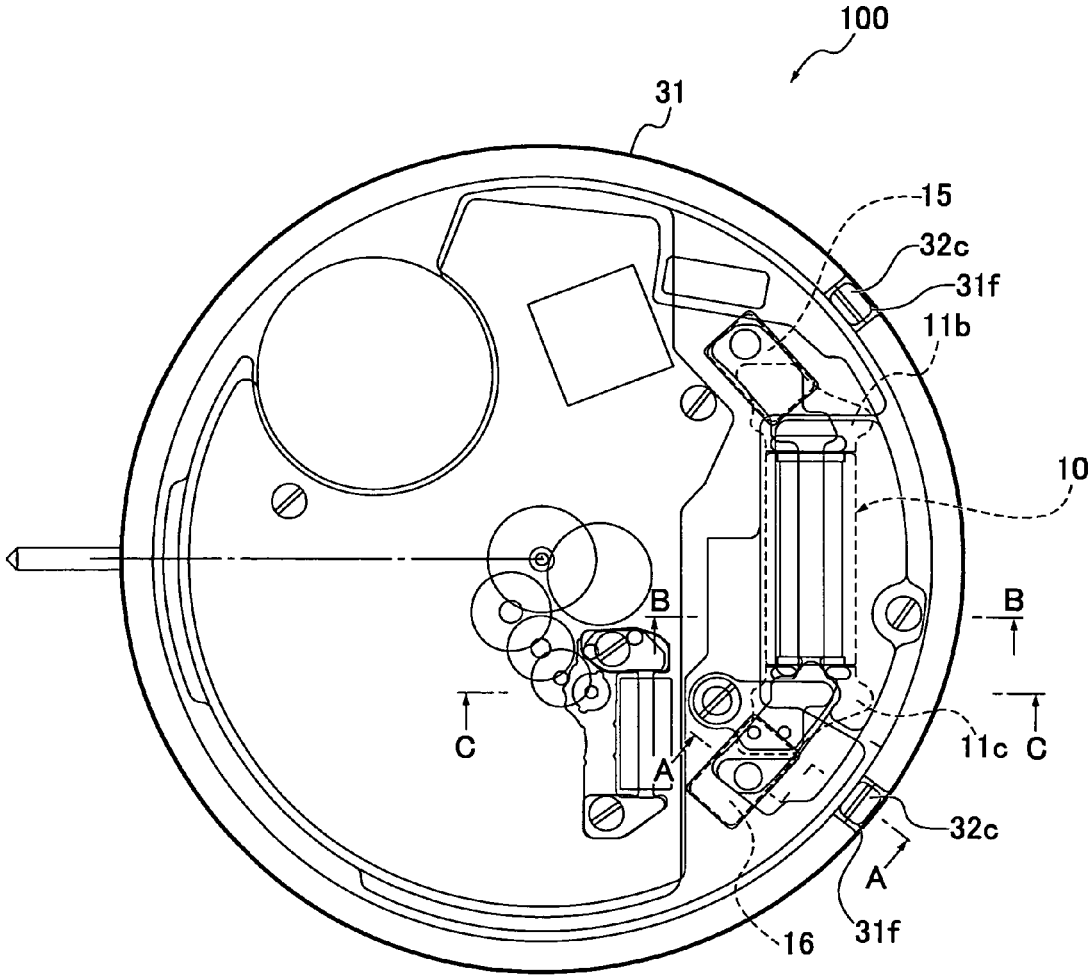
FIG. 6 is a transparent diagram of the radio-controlled timepiece of the embodiment seen from the back-lid side.
Figure 9A:
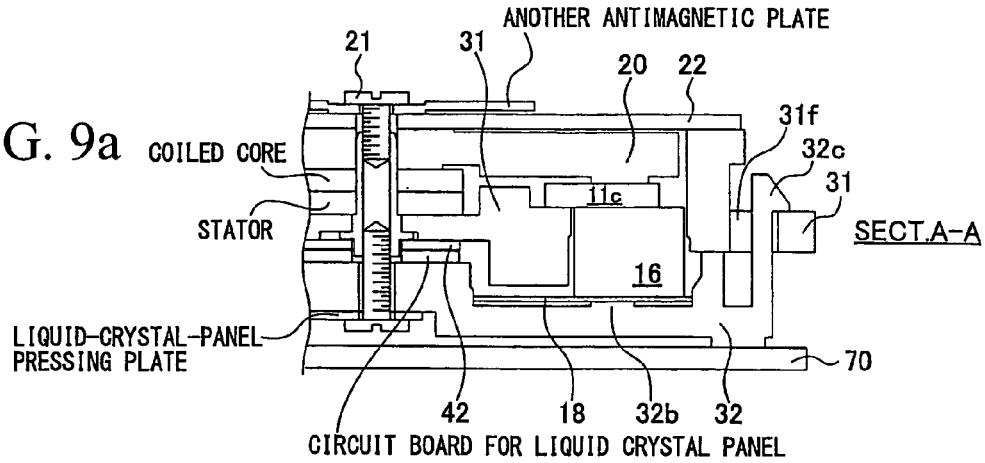
Figure 9B:
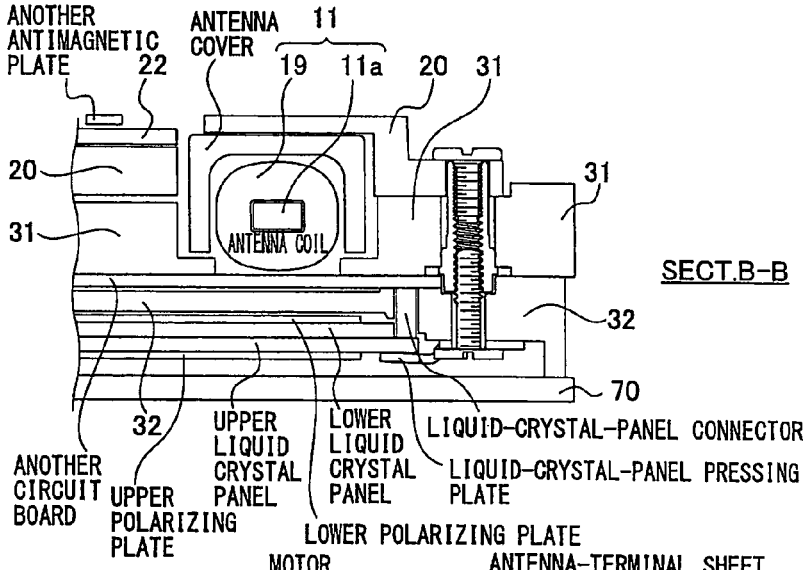
Figure 9C:
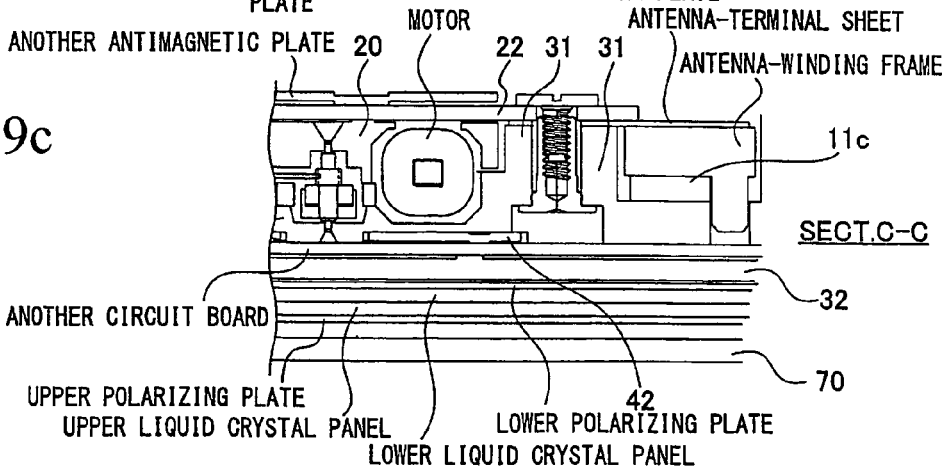

Parts of FIG. 9 are sectional diagrams illustrating, sections of FIG. 6 taken along the section lines A-A, B-B, and C-C, respectively.

Figure 7A:
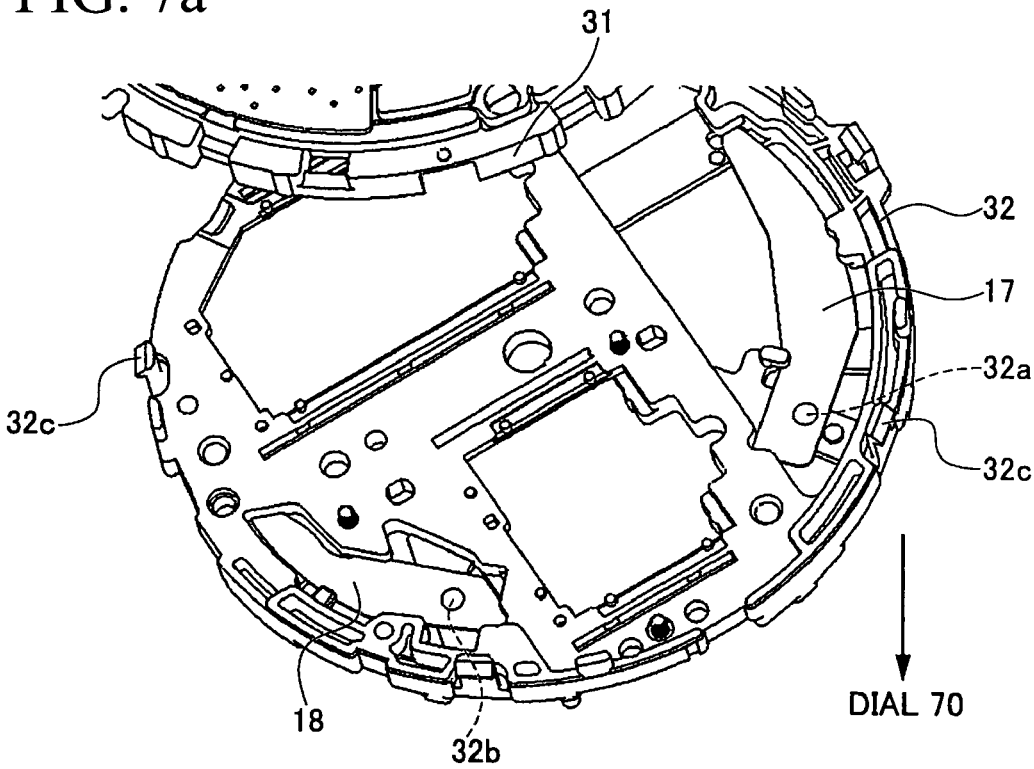
FIG. 7 is a perspective diagram illustrating magnetism-collection members disposed beforehand on a liquid-crystal-panel supporting frame. Part (a) of FIG. 7 is seen from the back-lid side whereas Part (b) of FIG. 7 is seen from the dial side.
Figure 7B:
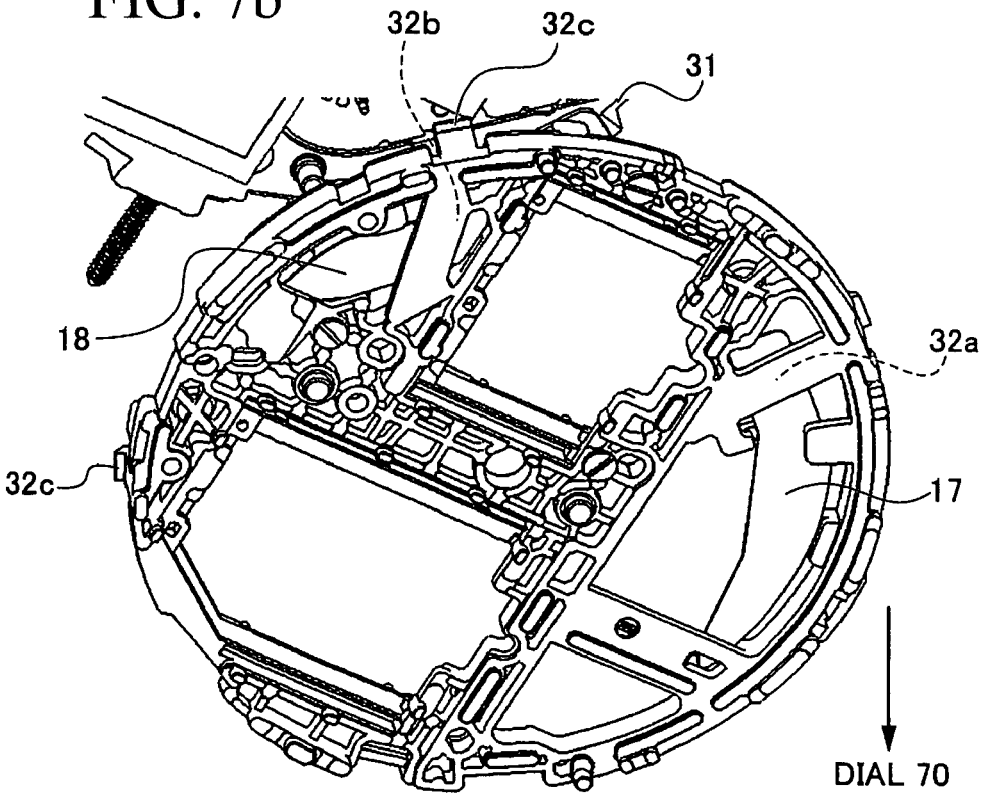
Figure 10:
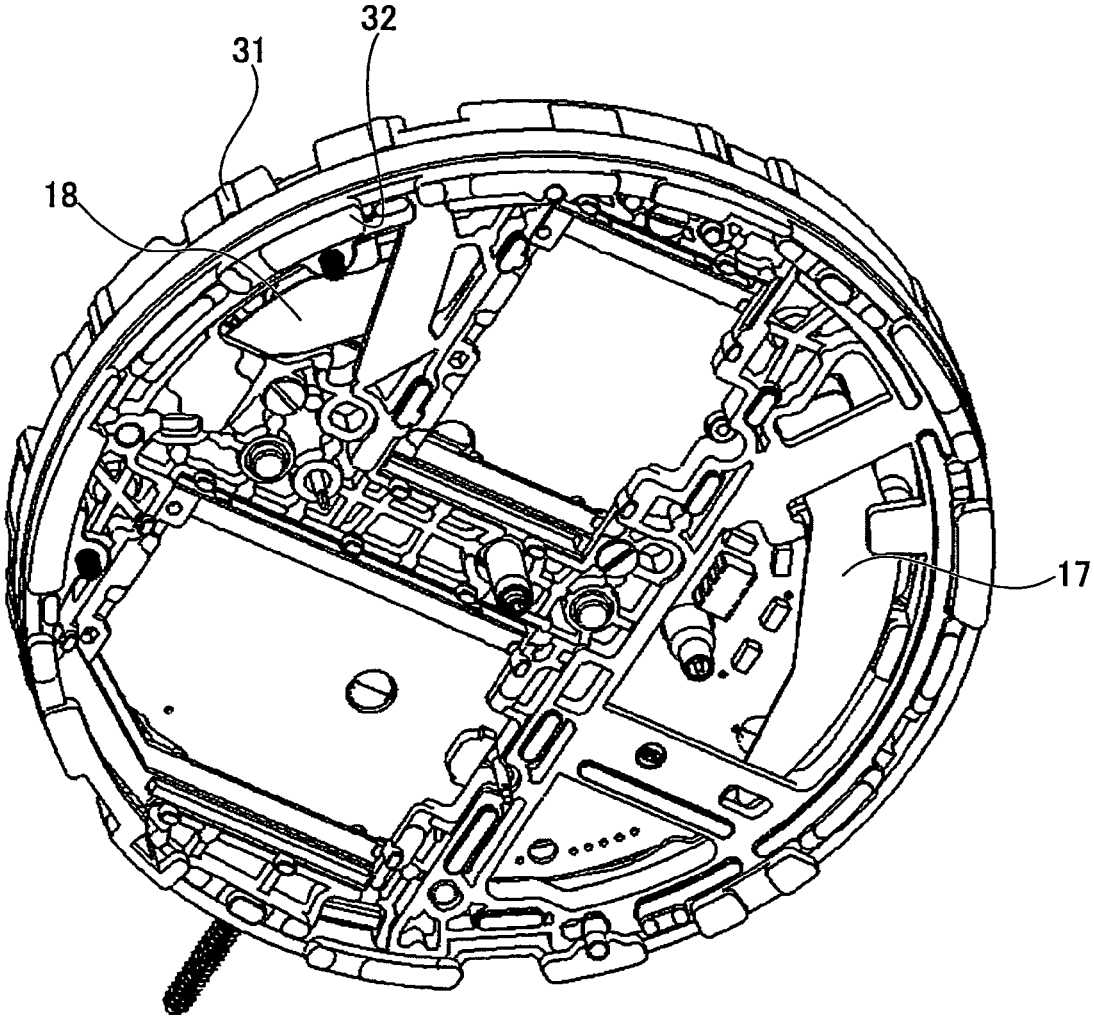

FIG. 10 is a perspective diagram (seen from the windshield-glass side) of a main plate and the liquid-crystal-panel supporting frame illustrated in FIG. 7 in the assembled state.

Figure 11:
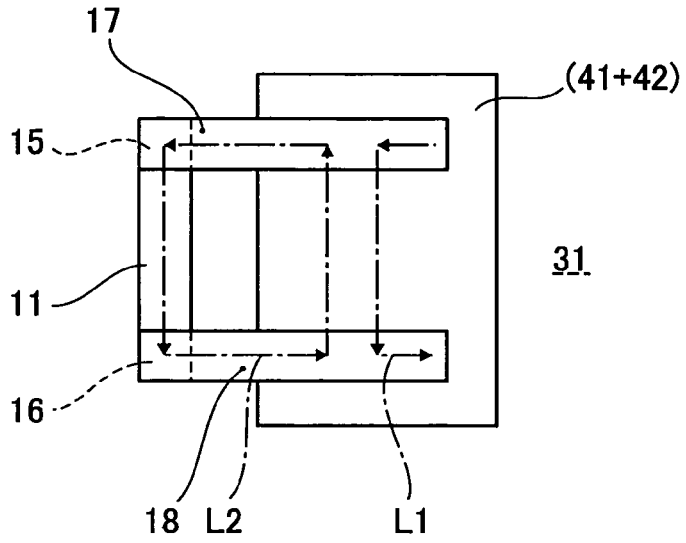

FIG. 11 is a schematic diagram illustrating a state where a magnetic path and a magnetic loop are formed in the antenna-core body via antimagnetic plates.

Figure 12:
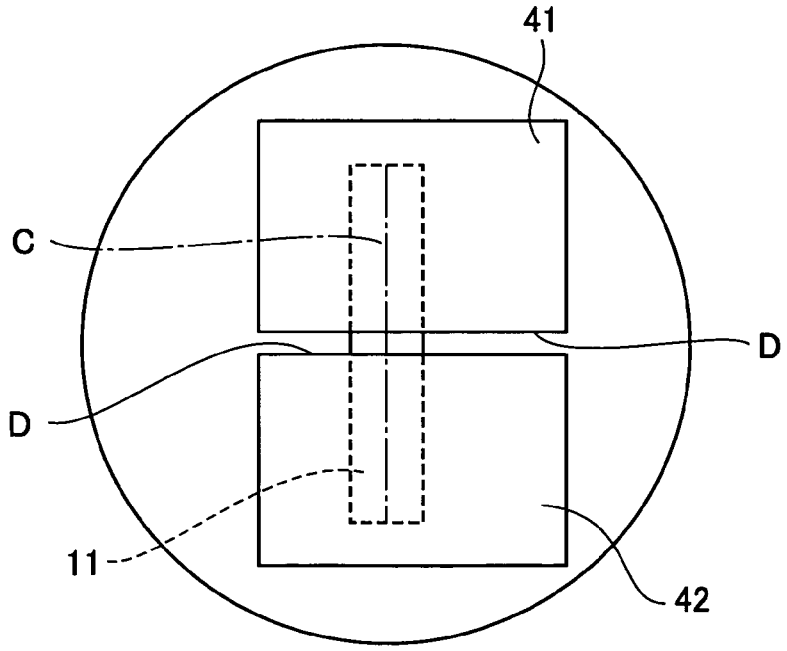

FIG. 12 is a schematic diagram illustrating a state where two-body-structure antimagnetic plates are used in a conventional antenna (which, specifically, refers to the antenna core and the coil in the present invention).

Figure 13A:
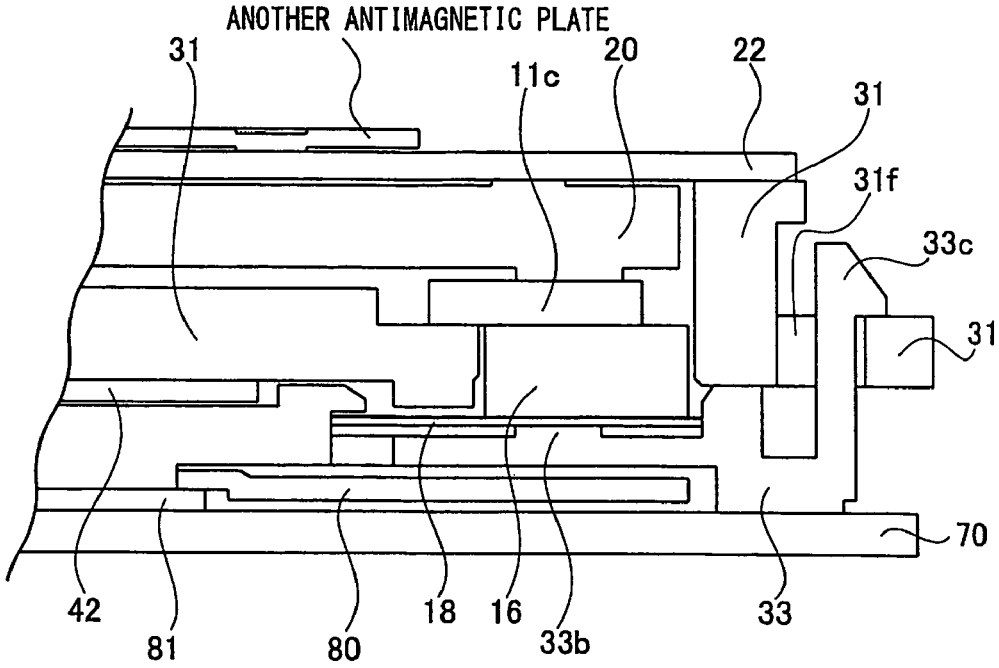
Figure 13B:
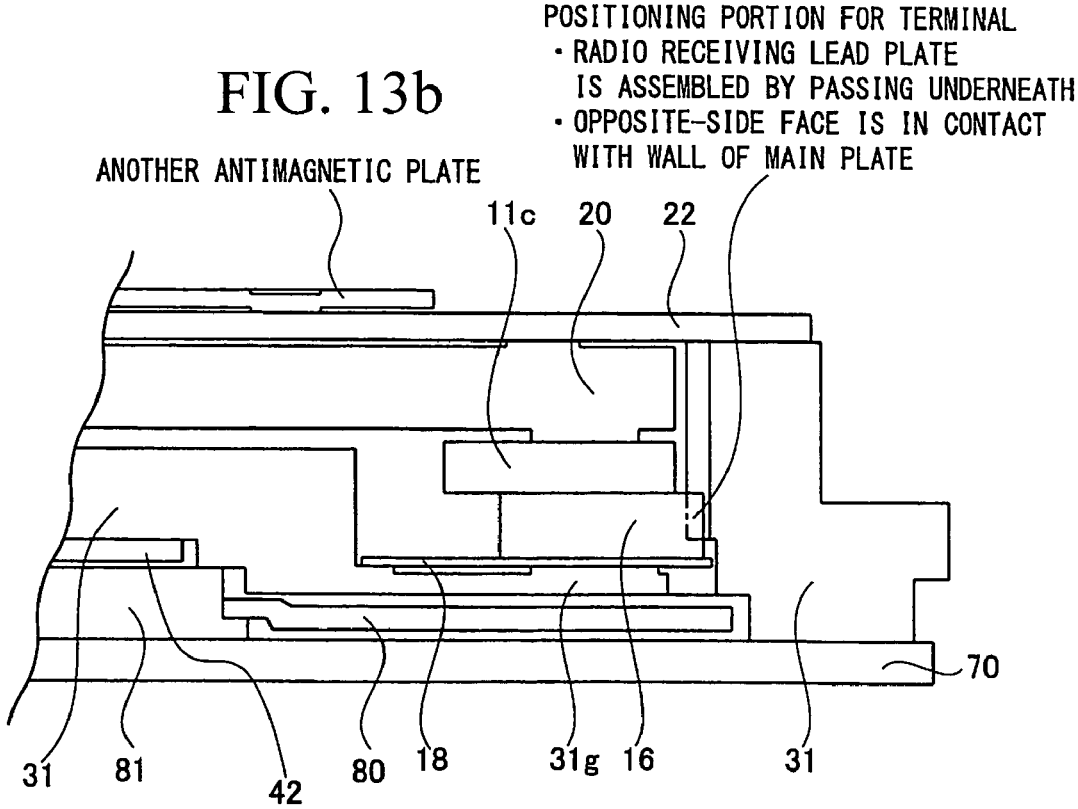

FIG. 13 is a sectional diagram corresponding to FIG. 9 illustrating a modified example (Part 1) where a calendar supporting frame is used as a pressing member.

Figure 14:
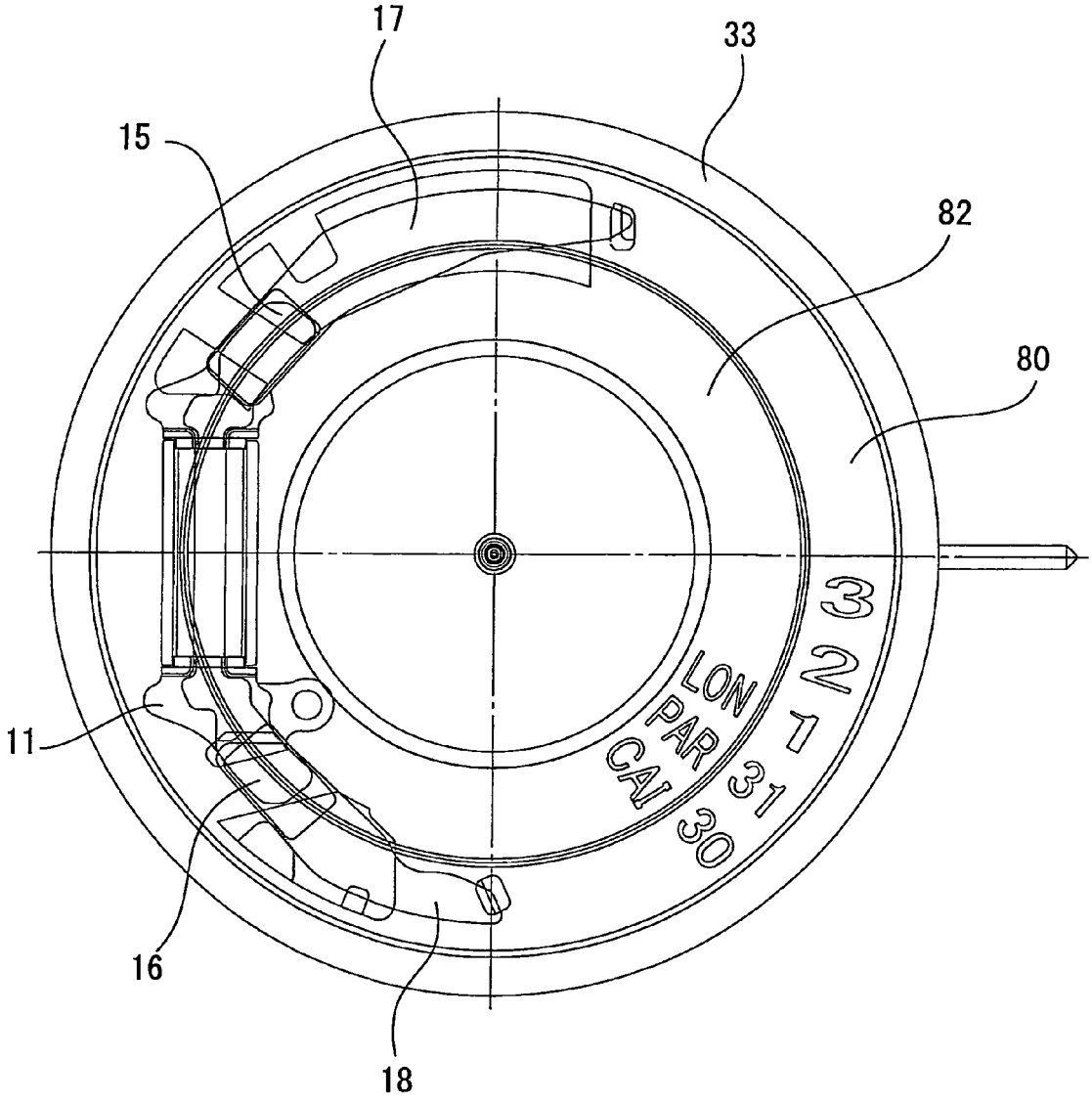

FIG. 14 is a transparent top-plan view illustrating another modified example where the calendar supporting frame is used as a pressing member and illustrating a state where the calendar supporting frame holds a date plate showing the date of the calendar information and a city displaying plate showing the name of a world city (or of a region), of which the timepiece shows the current time.

Figure 15A:
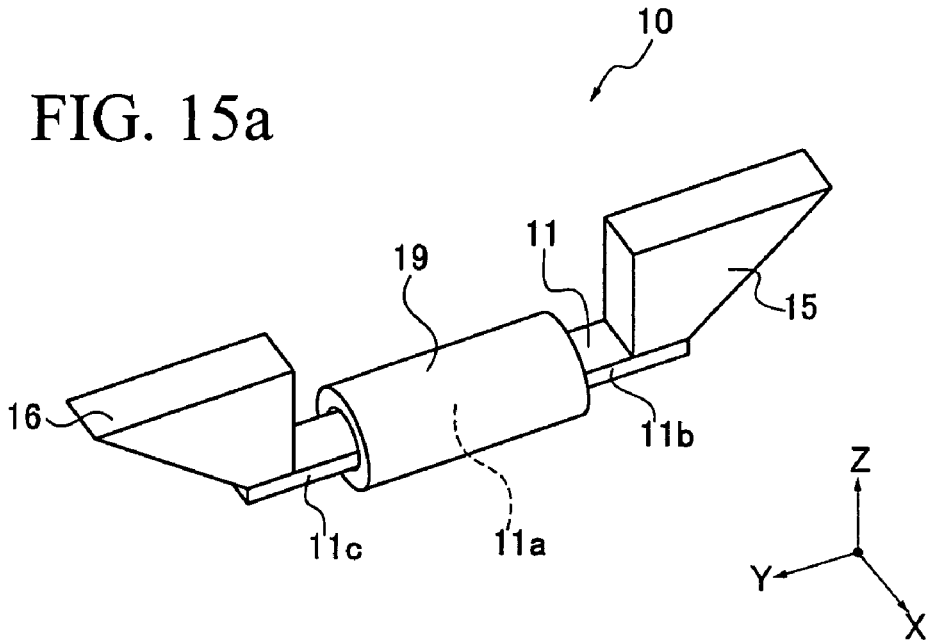
Figure 15B:
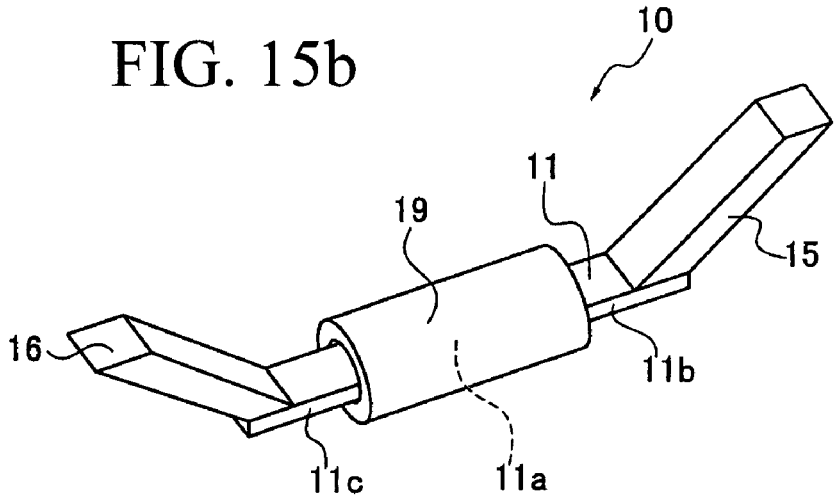
Figure 15C:
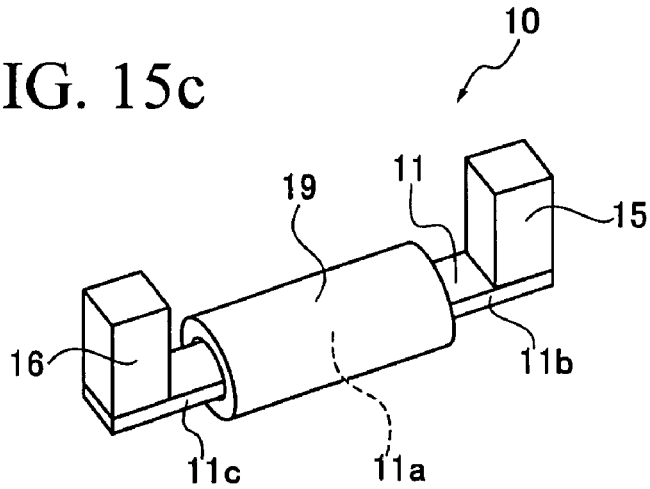

FIG. 15 is a perspective diagram illustrating an antenna-core body of a radio-controlled timepiece according to a modified example (Part 2) in which no magnetism-collection members are provided and the additional cores are in contact with the antenna core.

DESCRIPTION OF SYMBOLS

10 antenna
11 antenna core
11*a* coiled portion
11*b*, 11*c* extension portions
15, 16 additional cores
17, 18 magnetism-collection members
19 coil
31 main plate (timepiece substrate)
32 liquid-crystal-panel supporting frame (magnetism-collection-member supporting member/pressing member)
32*a*, 32*b* protrusion (pressing members)
33 guide member
100 radio-controlled timepiece

DETAILED DESCRIPTION OF THE INVENTION

A radio-controlled timepiece and a method of assembling a radio-controlled timepiece according to an embodiment of the present invention will be described below by referring to the drawings.

Figure 1:
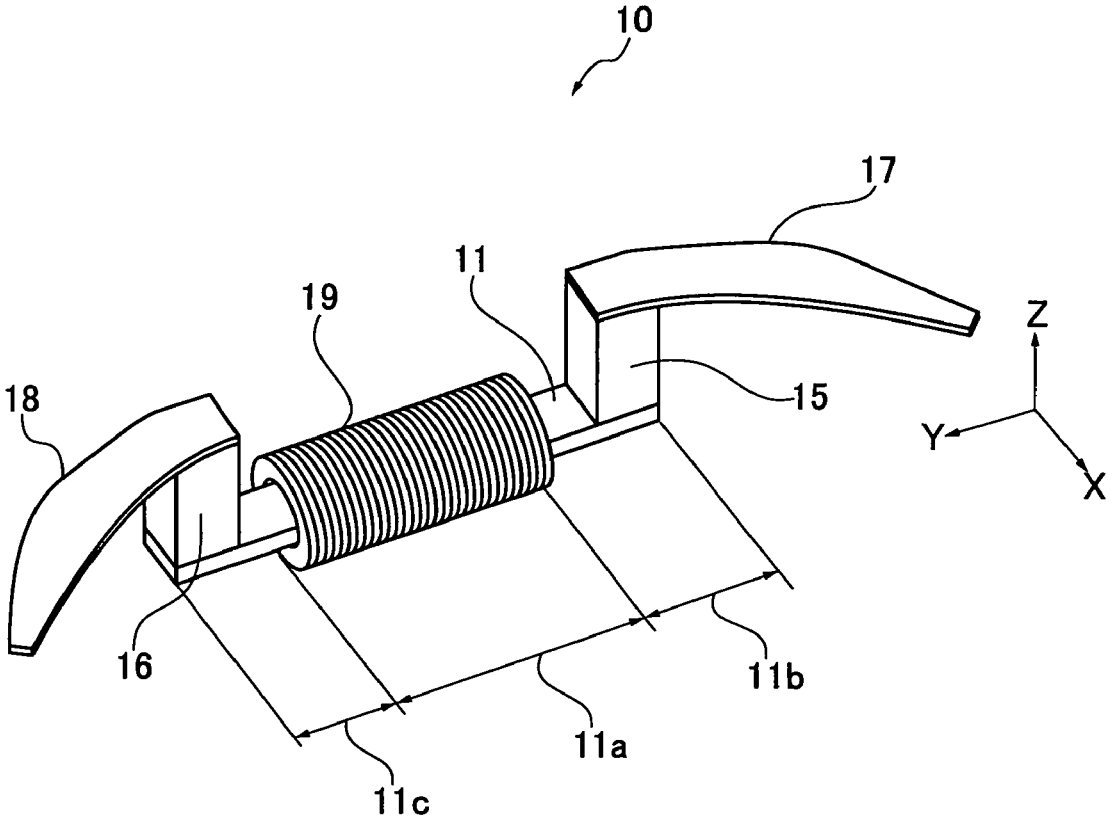
FIG. 1 is a schematic perspective diagram of an antenna for receiving standard signal provided in a radio-controlled timepiece according to an embodiment of the present invention.
Figure 2:
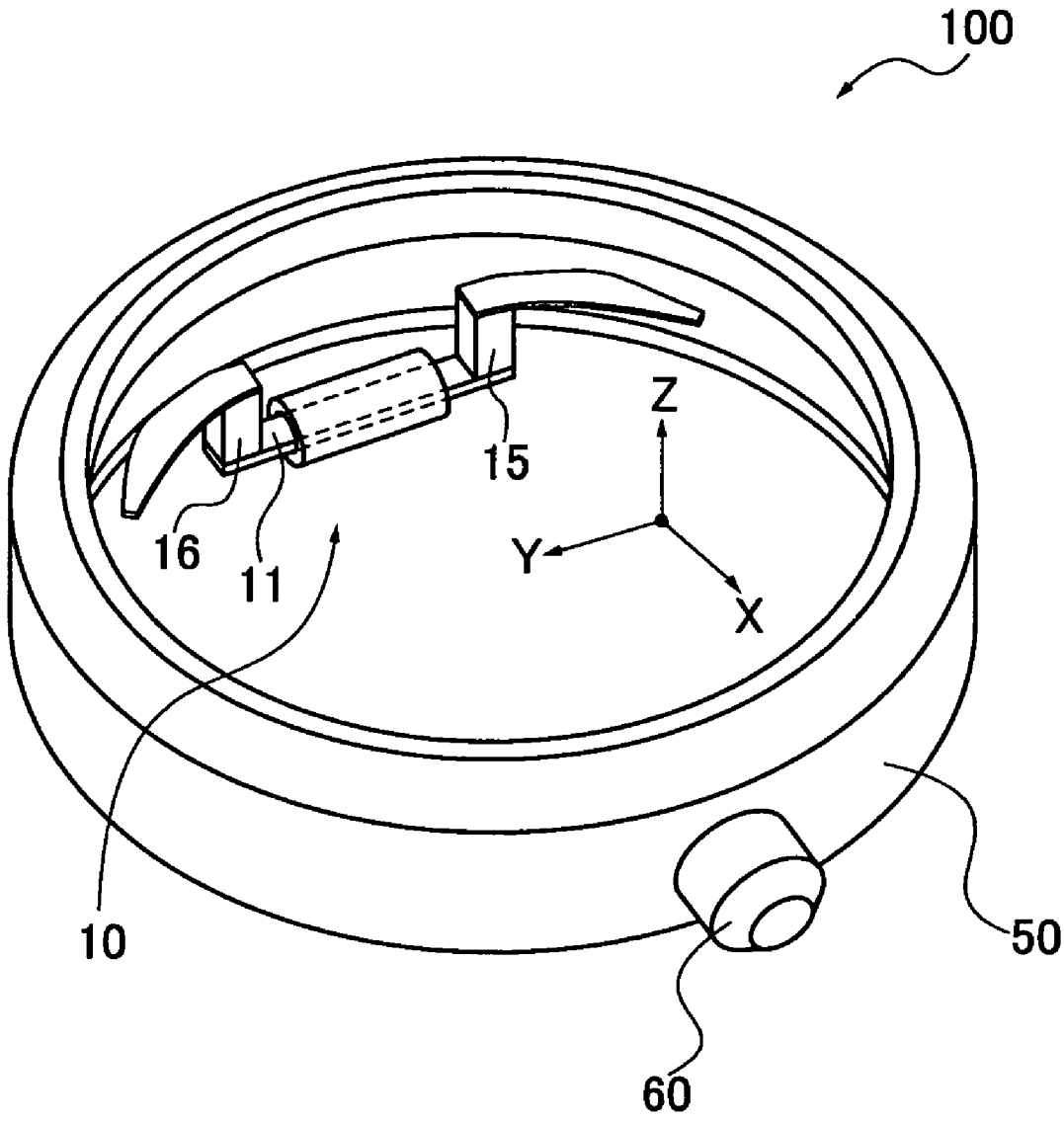
FIG. 2 is a schematic diagram illustrating the state in which the antenna of FIG. 1 is accommodated in a case of the timepiece.
Figure 3:
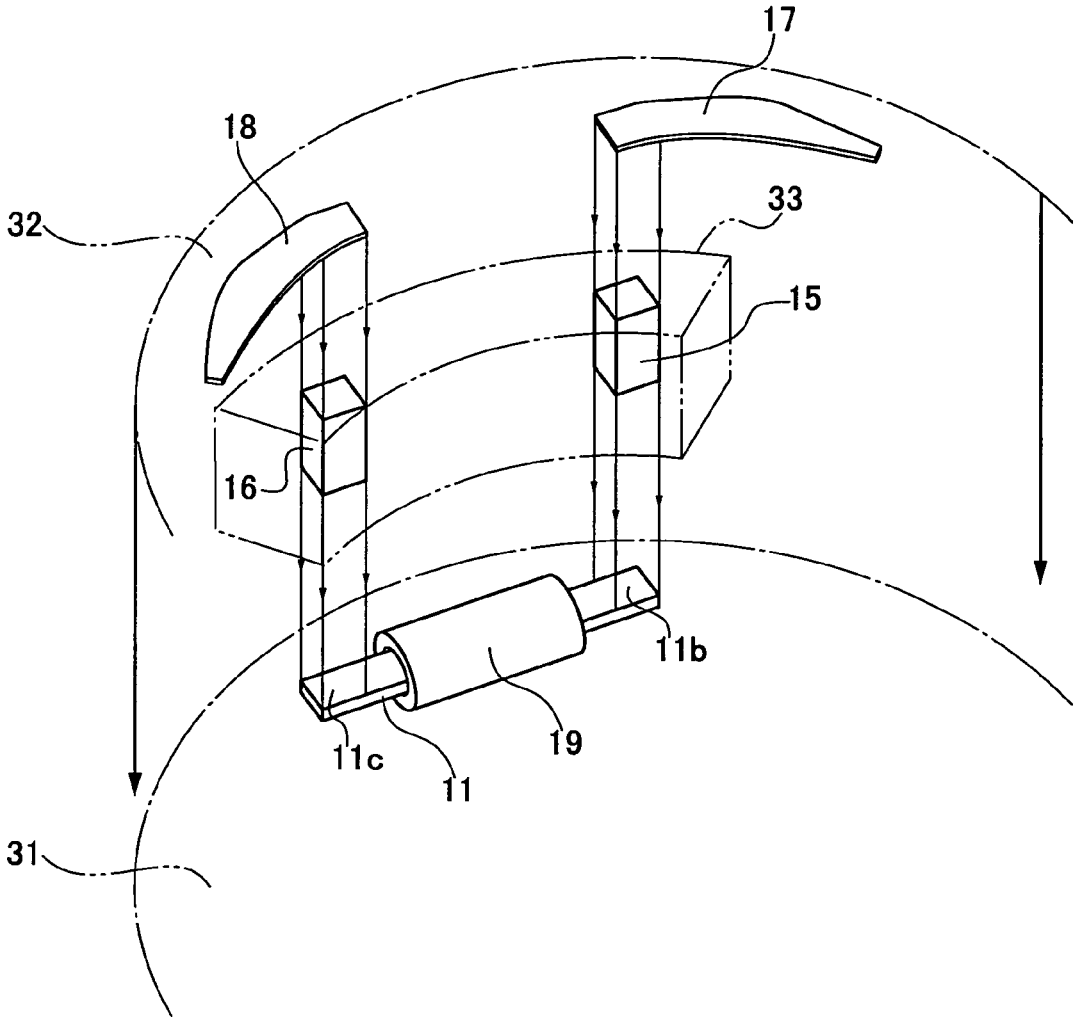
FIG. 3 is an exploded perspective diagram illustrating the components before being assembled into the antenna shown in FIG. 1.

FIG. 1 is a schematic perspective diagram of an antenna 10 for receiving the standard signal provided in a radio-controlled timepiece 100 according to an embodiment of the present invention. FIG. 2 is a schematic diagram illustrating the state in which the antenna 10 shown in FIG. 1 is accommodated in a case 50 of the timepiece 100. FIG. 3 is an exploded perspective diagram illustrating the components before being assembled into the antenna 10 shown in FIG. 1.

The antenna 10 illustrated in these drawings includes: an antenna core 11; a coil (electric wire) 19; additional cores 15 and 16; and magnetism-collection members 17 and 18. The antenna core 11 is made of an amorphous material (magnetic material) and is formed in a rectangular shape. The coil (electric wire) 19 is wound around the central portion of the antenna core 11. The antenna core 11 includes a coiled portion 11*a*, around which the coil 19 is wound, and two extension portions 11*b* and 11*c* that extend from the coiled portion 11*a* towards their respective two end portions of the antenna core 11 (i.e., the portions that stick out of the coil 19). Each of the additional cores 15 and 16 has one end face that is in contact with a face (XY-plane) of the corresponding one of the two extension portions 11*b* and 11*c*. Each of the additional cores 15 and 16 has a columnar shape rising up from the above-mentioned face of the corresponding one of the extension portions 11*b* and 11*c* towards an unillustrated windshield glass (i.e., upwards, or in Z-direction, in the drawings). The additional cores 15 and 16 are made of an amorphous material. The magnetism-collection members 17 and 18 are also made of an amorphous material. Each of the magnetism-collection members 17 and 18 is formed as an arc-shaped plate, and is in contact with the other-end face of the corresponding one of the additional cores 15 and 16. Each of the magnetism-correction members 17 and 18 extends outward beyond the end of the corresponding one of the extension portions 11*b* and 11*c* of the antenna core 11.

As FIG. 2 shows, the antenna 10 is set in the case 50 of the timepiece 100 so that the antenna core 11 (specifically, the plate face thereof) can be substantially parallel with the face (XY-plane) of a dial (not illustrated) of the timepiece 100. In addition, the antenna 10 is placed so that the additional cores 15 and 16 can rise up in the thickness direction of the timepiece 100. Reference numeral 60 in FIG. 2 represents a crown of the timepiece 100.

As shown in FIG. 3, in the timepiece 100 of this embodiment, a main plate 31 (timepiece substrate) made of a non-magnetic material supports the antenna core 11 wound with the coil 19. A guide portion 33 made of a non-magnetic material supports the additional cores 15 and 16. A liquid-crystal-panel supporting frame 32 (magnetism-collection-member supporting member), made of a non-magnetic material and holding an unillustrated liquid crystal panel, supports the magnetism-collection members 17 and 18.

Figure 4B:
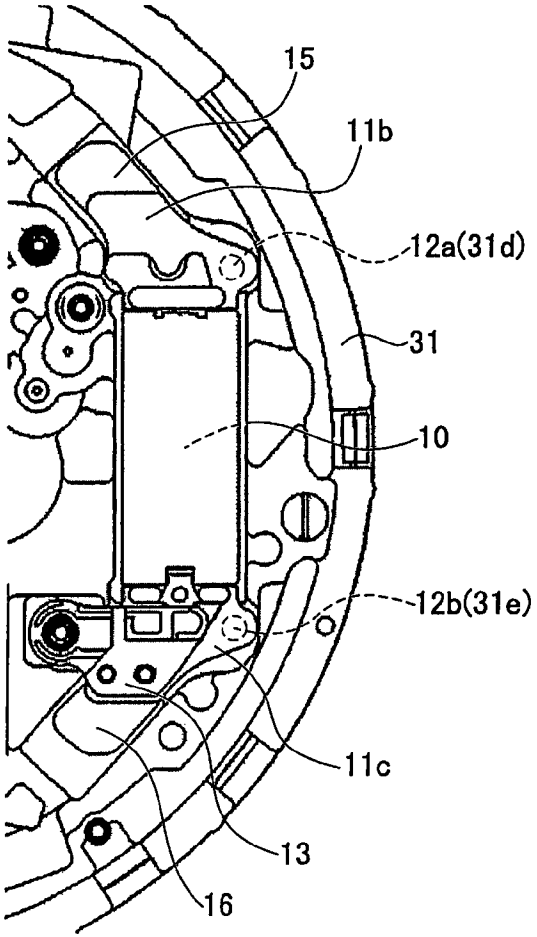
FIG. 4 is a plan diagram of a main plate of the timepiece seen from the back-lid side of the timepiece (Part 1).
Figure 4A:
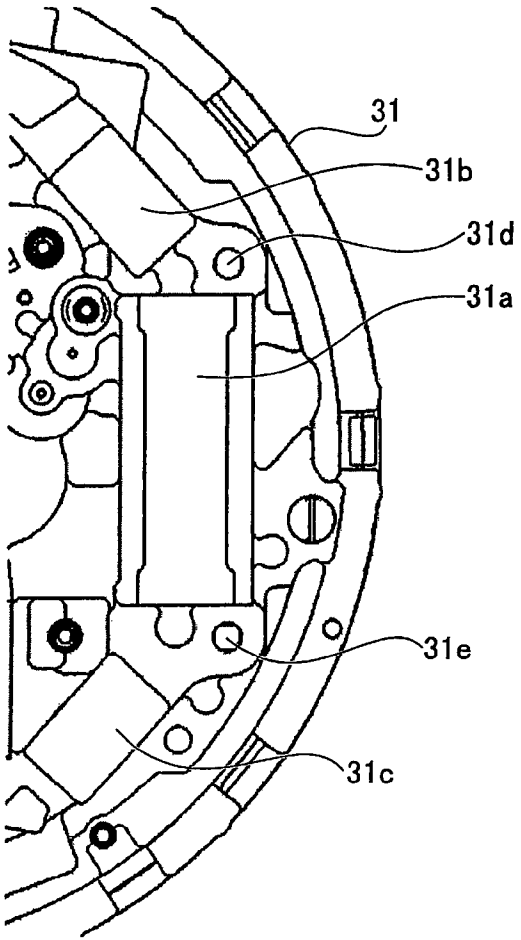

Positioning holes 31*d* and 31*e* are formed in the main plate 31 as shown in FIG. 4(*a*). The positioning holes 31*d* and 31*e* are used to place the antenna core 11 at a predetermined position and in a predetermined attitude. An escape hole 31*a* is formed in the main plate 31 so that the antenna core 11 is supported within a face of the main plate 31 and so that the coiled portion 11*a* and the coil 19 of the antenna core 11 are prevented from interfering with the surface of the main plate 31.

Figure 5B:
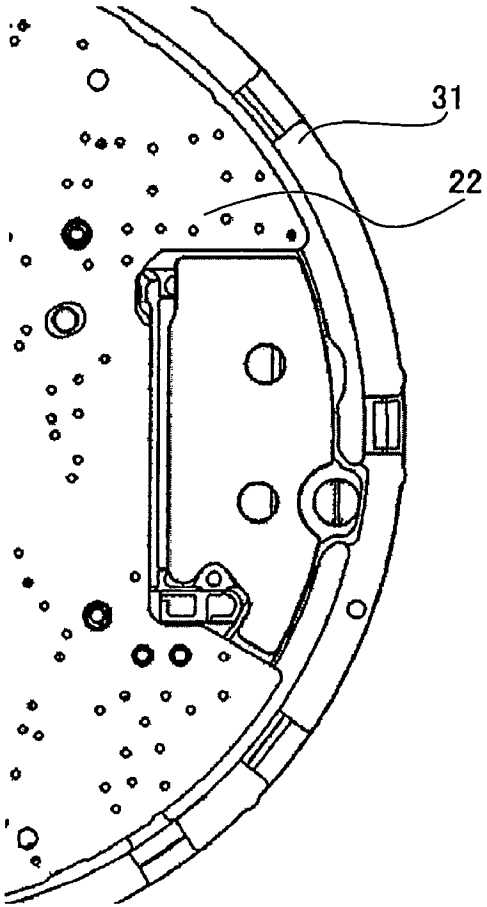
FIG. 5 is a plan diagram of the main plate of the timepiece seen from the back-lid side of the timepiece (Part 2).
Figure 5A:
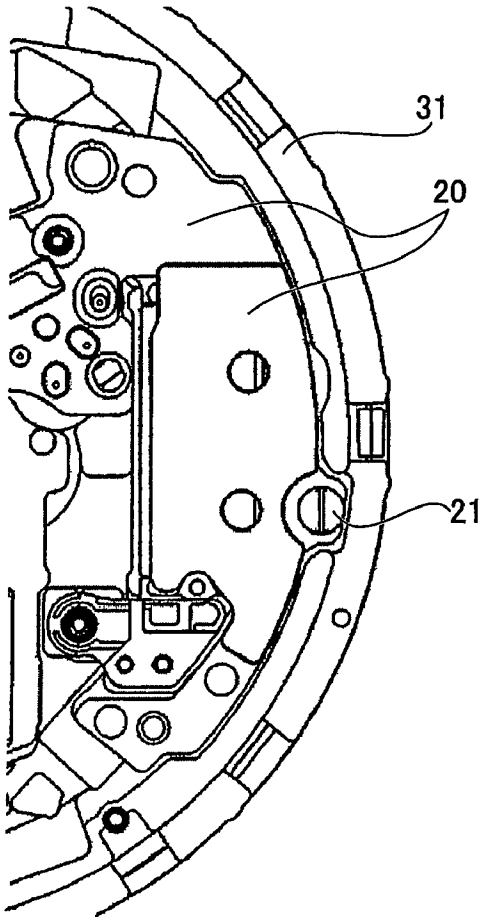

The antenna core 11 wound with the coil 19 is set on the main plate 31, and then the additional cores 15 and 16 are brought in from the windshield-glass side so as to come in contact with the extension portions 11*b* and 11*c* respectively (see FIG. 4(*b*)). In addition, the antenna core 11 is covered with a wheel-train bearing 20 (antenna supporting portion) and a circuit board 22 from the back-lid side (i.e., from the opposite side to the windshield glass) of the timepiece 100 (see FIGS. 5(*a*) and (*b*)). The wheel-train bearing 20 is fixed by a screw 21, and serves as a supporting portion to receive the biasing force acting on the antenna.

In the timepiece 100 of this embodiment, the main plate 31 serves also as the guide portion 33 that supports the additional cores 15 and 16. Support holes 31*b* and 31*c*, which are formed in the main plate 31, serve as additional-core supporting portions used for supporting the additional cores 15 and 16, respectively, so that the additional cores 15 and 16 can rise up in the thickness direction of the timepiece 100.

Note that the guide portion 33 may be formed as a member independent of the main plate 31. If such a configuration is adopted, the guide portion 33 is required to be made of a non-magnetic material as well.

In addition, as shown in FIG. 4(*b*), positioning bosses 12*a* and 12*b* are formed, respectively, on the extension portions 11*b* and 11*c* of the antenna core 11, and are fitted, respectively, to the positioning holes 31*d* and 31*e* formed in the main plate 31. Accordingly, the antenna core 11 is supported by the main plate 31 and is thus positioned at a predetermined position and in a predetermined attitude. Specifically, the antenna core 11 is supported so that the plate face of the antenna core 11 can be within a face of the main plate 31 (including a case where the plate face of the antenna core 11 is parallel with a face of the main plate 31).

Parts of the extension portions 11*b* and 11*c* of the antenna core 11 protrude respectively into the support holes 31*b* and 31*c*, and cover partially their respective support holes 31*b* and 31*c*. The one face of each of the additional cores 15 and 16 placed in and supported by the corresponding one of the support holes 31*b* and 31*c* is now capable of coming into contact with the corresponding one of the extension portions 11*b* and 11*c* that protrude into the support holes 31*b* and 31*c*, respectively (see FIG. 4(*b*) and FIG. 6).

In FIG. 4(*b*), reference numeral 13 denotes a small circuit board on which a circuit to extract the wave-detection current from the coil 19 of the antenna 10 is formed. FIG. 6 is a transparent diagram of the radio-controlled timepiece 100 seen from the back-lid side.

As shown in FIGS. 7(*a*) and (*b*), the magnetism-collection members 17 and 18 have been supported, in advance, by the liquid-crystal-panel supporting frame 32, which is stacked on the dial-side face of the main plate 31. The magnetism-collection members 17 and 18 are supported at the positions where the end portions of the magnetism-collection members 17 and 18 are laid, in the up-and-down direction (the thickness direction of the timepiece 100), over the other one end faces of the additional cores 15 and 16 (the other one end faces being referred to the end faces positioned on the opposite side to the end faces that are in contact with the antenna core 11) that are supported by the main plate 31.

Protrusions 32*a* and 32*b* (pressing members) are formed on the liquid-crystal-panel supporting frame 32 in portions corresponding to the portions of the magnetism-collection members 17 and 18 which are laid over the other one end faces of the additional cores 15 and 16. The protrusions 32*a* and 32*b* respectively press the magnetism-collection members 17 and 18 towards the main plate 31 (see FIGS. 7 and 8).

Figure 8:
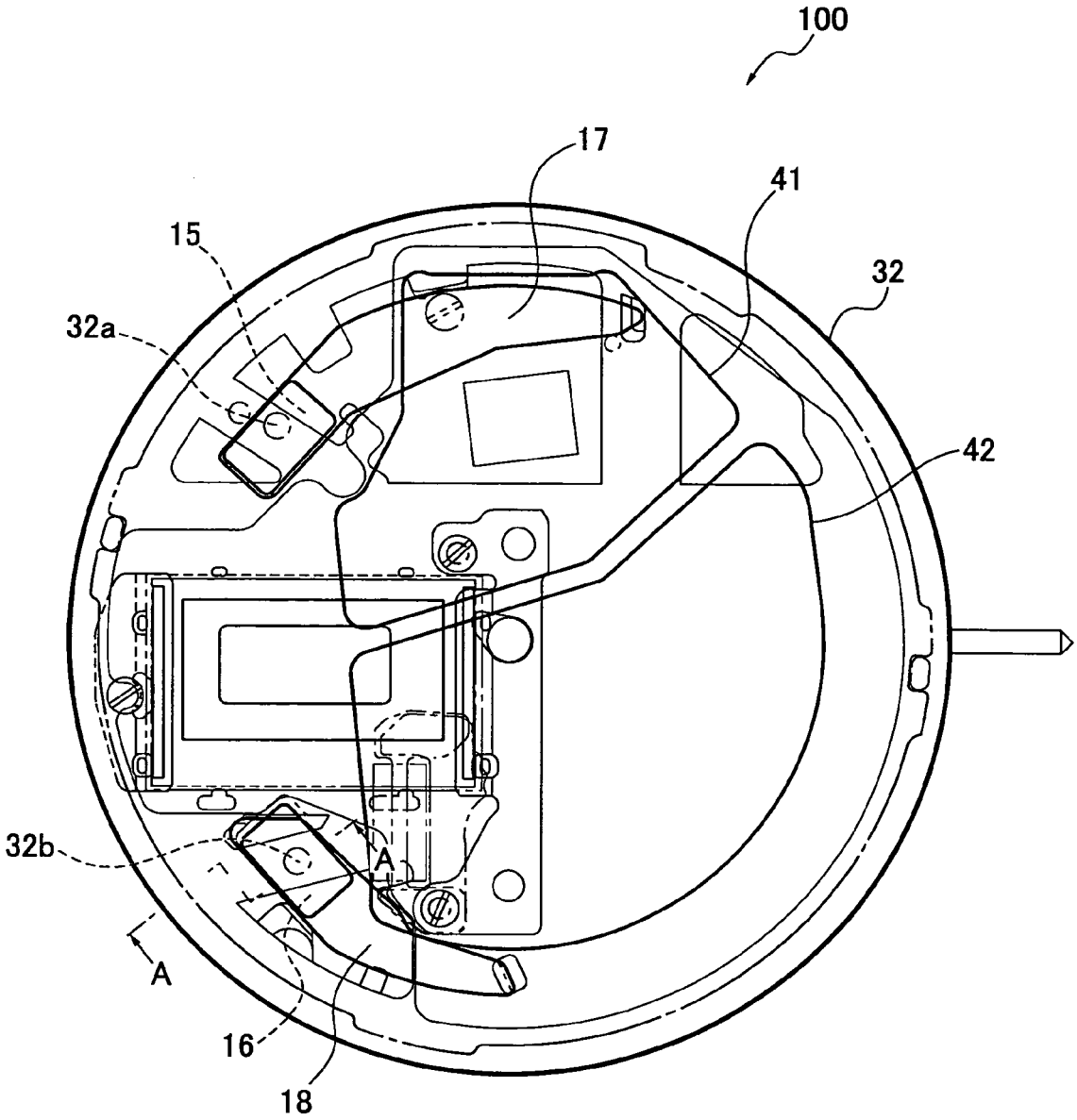
FIG. 8 is a transparent diagram of the radio-controlled timepiece of the embodiment seen from the windshield-glass side.

FIG. 8 is a transparent diagram of the radio-controlled timepiece 100 seen from the windshield-glass side (i.e., from the dial side). FIG. 8 shows the relative positions, when viewed from above, of the liquid-crystal-panel supporting frame 32, the additional cores 15 and 16, the magnetism-collection members 17 and 18, and the protrusions 32*a* and 32*b*.

FIGS. 9(*a*), (*b*), and (*c*) illustrate sections taken along the section lines A-A, B-B, and C-C of FIG. 6, respectively.

To assemble the liquid-crystal-panel supporting frame 32 and the main plate 31 together, the liquid-crystal-panel supporting frame 32 and the main plate 31 are laid over each other so that engagement pegs 32*c* of the liquid-crystal-panel supporting frame 32 can engage, respectively, with the engagement holes 31*f* formed in the main plate 31 (see FIG. 9(*a*)). In the state where the liquid-crystal-panel supporting frame 32 and the main plate 31 are assembled together (see FIG. 10), each of the protrusions 32*a* and 32*b* of the liquid-crystal-panel supporting frame 32 presses and biases the corresponding one of the magnetism-collection members 17 and 18 towards the corresponding one of the additional cores 15 and 16 (see Part (a) of FIG. 9). Accordingly, the magnetism-collection members 17 and 18 come into contact with the additional cores 15 and 16, respectively. The magnetism-collection members 17 and 18, furthermore, press the additional cores 15 and 16, respectively, so that the additional cores 15 and 16 come into contact, respectively, with the extension portions 11*b* and 11*c* of the antenna core 11. Thus, the magnetism-collection member 17, the additional core 15, the antenna core 11, the additional core 16, and the magnetism-collection member 18 are magnetically connected together to form a larger, functionally-integrated, antenna-core body, which has an appearance of an integrated unit.

According to the radio-controlled timepiece 100 of this embodiment, the larger-sized antenna-core body can enhance the reception sensitivity. In addition, the additional cores 15 and 16 do not extend towards the metal back lid, but rise up towards the windshield glass (in the Z-direction) which allows the standard signal to pass therethrough more easily. Thus, is a structure is achieved in which the integrated antenna-core body including the additional cores 15 and 16 as well as the antenna core 11 faces the windshield glass, and the structure can further enhance the reception sensitivity.

In addition, the antenna core 11, the additional cores 15 and 16, and the magnetism-collection bodies 17 and 18 are formed as members that are separated from one another before they are assembled together. Accordingly, changing, in various ways, a contact angle made by these cores, contact positions of these cores, and the like allows the shape of the integrated antenna-core body to be formed freely to a certain degree. The degree of freedom for the appearance of the antenna-core body can be higher than in the conventional case where the antenna-core body of a desired shape is formed by bending the antenna core that has been originally provided as a single, integrated body.

Accordingly, by bringing the additional cores 15 and 16 into contact with the antenna core 11 so that the additional cores 15 and 16 can rise up in the thickness direction of the timepiece 100, the antenna-core body, as a single entity, can be formed so as to have a three-dimensionally expanding shape. This antenna-core body can further enhance the reception sensitivity compared to that obtainable in the case where only an antenna core is simply increased in size within a single plane. Even within the limited space in the case 50 of the timepiece 100, the degree of freedom of the placement of the antenna 100 is higher than those in conventional cases.

In addition, the antenna core 11 is supported by the main plate 31 and the wheel-train bearing 20 within a face of the main plate 31 (see FIG. 9(*b*)). The additional cores 15 and 16 are supported respectively by the support holes 31*b* and 31*c* of the main plate 31 that serves also as the guide portion 33 in such a way as to rise up in the thickness direction of the timepiece 100. Each of the protrusions 32*a* and 32*b* of the liquid-crystal-panel supporting frame 32 biases the corresponding one of the additional cores 15 and 16 via the corresponding one of the magnetism-collection members 17 and 18 so that the additional cores 15 and 16 bring the one faces thereof into contact respectively with the extension portions 11*b* and 11*c* of the antenna core 11. Accordingly, assembling the components into the antenna-core body in this embodiment is easier than in the case of assembling without the main plate 31, the guide member 33, or the liquid-crystal-panel supporting frame 32.

In addition, the radio-controlled timepiece 100 of this embodiment includes: the magnetism-collection members 17 and 18 made of an amorphous material; and the liquid-crystal-panel supporting frame 32 that supports the magnetism-collection members 17 and 18. The liquid-crystal-panel supporting frame 32 supports the magnetism-collection members 17 and 18 so that each of the magnetism-collection members 17 and 18 can be disposed between the corresponding one of the protrusions 32*a* and 32*b* and the corresponding one of the end faces of the additional cores 15 and 16. Here, the magnetism-collection members 17 and 18 come into contact respectively with the end faces of the additional cores 15 and 16. Accordingly, the magnetism-collection members 17 and 18, which serve as parts of the antenna-core body, are further magnetically connected to the antenna core 11 and the additional cores 15 and 16 so as to form a functionally-integrated unit and so as to have an external appearance of a single body. Thus formed is a larger antenna-core body, which can enhance the reception sensitivity.

Incidentally, since the magnetism-collection members 17 and 18, which are made of a brittle material and are thin and fragile, are supported by the liquid-crystal-panel supporting frame 32, it is easier to attach the magnetism-collection members 17 and 18 respectively to the additional cores 15 and 16 than in the case where each of the magnetism-collection members 17 and 18 are attached to the corresponding one of the additional cores 15 and 16 without any help.

If the magnetism-collection members 17 and 18 had to be fixed directly to the main plate 31, bosses or the like would be required for the fixation, and a machining work to drill holes in the magnetism-collection members 17 and 18 would be necessary. It is not easy, however, to drill the thin, magnetism-collection members 17 and 18 made of a brittle material. It is even more difficult in mass production to form holes if the holes had to be punched using dies. The use of the liquid-crystal-panel supporting frame 32 to support the magnetism-collection members 17 and 18 as in the case of this embodiment can eliminate the above-described problem.

In addition, the extension portions 11*b* and 11*c* are formed respectively on the two end sides of the antenna core 11. The additional cores 15 and 16 are biased towards and brought into contact with their corresponding extension portions 11*b* and 11*c* that are formed, respectively, on the two end sides of the antenna core 11. Accordingly, making the additional cores 15 and 16 correspond respectively to the extension portions 11*b* and 11*c* allows the reception of the standard signal to be balanced appropriately.

In addition, the antenna core 11 is made of an amorphous material, that is, a brittle material, and thus has difficulty in being bent due to its physical properties. The radio-controlled timepiece 100 of this embodiment, however, can obtain the effect obtainable by bending the antenna core 11. Specifically, the effect is that the end portions of the antenna core 11 can be brought closer to a member, such as the windshield glass, that allows the standard signal to pass therethrough more easily than a metal case does. Accordingly, the antenna 11 can enhance its own practical utility.

The antenna 10 most easily receives the standard signal at the leading-end portions of the additional cores 15 and 16 (or, at the leading-end portions of the magnetism-correction members 17 and 18 in the radio-controlled timepiece 100 that has the magnetism-correction members 17 and 18 added thereto). In the radio-controlled timepiece 100 of this embodiment, the leading-end sides of the additional cores 15 and 16 are directed towards the windshield glass. Accordingly, the leading-end side of each of the additional cores 15 and 16 is positioned quite closely to the windshield glass and is formed to be a flat surface with a broader area, and thus easily receive the standard signal that enters through the windshield glass.

Accordingly, even if the case 50, the back lid, and other portions of the timepiece 100 except for the windshield glass are made of a metal to improve the external appearance, the antenna 10 can be prevented from having a less performance to receive the standard signal.

As described above, the radio-controlled timepiece 100 of this embodiment employs some existing members. Specifically, the main plate 31 and the liquid-crystal-panel supporting frame 32 are used as a timepiece substrate, a guide member, and pressing members of the radio-controlled timepiece of the present invention. Accordingly, no additional new components dedicated for this radio-controlled timepiece 100 are necessary, so that an increase in manufacturing cost by use of additional components can be prevented.

In addition, in the assembling processes, the following two processes are carried out in a parallel manner: a process of setting the antenna core 11 and the additional cores 15 and 16 in the main plate 31; and a process of setting the magnetism-collection members 17 and 18 in the liquid-crystal-panel supporting frame 32. Then, in a final process, the liquid-crystal-panel supporting frame 32 is made to engage with the main plate 31 so as to be assembled together. Accordingly, the magnetism-collection member 17, the additional core 15, the antenna core 11, the additional core 16, and the magnetism-collection member 18 are magnetically connected together to form a larger, functionally-integrated, antenna-core body. Consequently, the time needed for the assembling processes can be shortened.

In the radio-controlled timepiece 100 of this embodiment, the antenna core 11 that is positioned closely to the back lid is offset, in the thickness direction of the timepiece 100, from the magnetism-collection members 17 and 18 that are positioned closely to the windshield glass. Accordingly, the space between the antenna core 11 and the magnetism-collection members 17 and 18 (i.e., the space in between in the thickness direction) can be used to place antimagnetic plates 41 and 42 that prevent or reduce the influence of the external magnetic field on the motors and the like (see FIGS. 8 and 9).

The magnetism-collection members 17 and 18 are closer to the upper surface (i.e., to the windshield glass) than the antimagnetic plates 41 and 42 are. Accordingly, the performance of the magnetism-collection members 17 and 18 to receive the standard signal is not negatively affected, or lowered down, by the antimagnetic plates 41 and 42. In addition, the motor and the like are closer to the lower surface (i.e., back-lid side) than the antimagnetic plates 41 and 42 are. Accordingly, the influence of the external magnetic field on the motor and the like can be prevented effectively.

In addition, the magnetism-collection members 17 and 18 are offset, in the thickness direction, from the antimagnetic plates 41 and 42. Accordingly, even if overlaid with each other when viewed from above, the magnetism-collection members 17 and 18 and the antimagnetic plates 41 and 42 are not adversely affected in their performances by each other. For this reason, the magnetism-collection members 17 and 18 as well as the antimagnetic plates 41 and 42 can have larger areas, so that the performance of the magnetism-collection members 17 and 18 and the performance of the antimagnetic plates 41 and 42 can be enhanced simultaneously.

The antimagnetic plates 41 and 42 are two bodies independent of each other: one is the antimagnetic plate 41 that is laid over the magnetism-collection member 17 when viewed from above; and the other is the antimagnetic plate 42 that is laid over the magnetism-collection member 18 when viewed from above.

In view of the antimagnetic performance, the antimagnetic plate 41 and the antimagnetic plate 42 may be integrated with each other to form a single plate, but in this embodiment, the antimagnetic plates 41 and 42 are separated from each other so as to be two different bodies as described above by the following reasons.

Since the magnetism-collection members 17 and 18 are laid respectively over the antimagnetic plates 41 and 42 when viewed from above, an integrated structure of the antimagnetic plates 41 and 42 (hereafter, referred to as an antimagnetic plate (41+42)) may lower down the reception performance for the following reasons (1) to (3). (1) A magnetic path (a magnetic path L1 in FIG. 11), the magnetism-collection member 17→the antimagnetic plate (41+42)→the magnetism-collection member 18, is formed, so that the received magnetic field of the standard signal uses the above-mentioned magnetic path as a bypass, resulting in a reduction in the standard signal acquired to the antenna-core body. (2) A magnetic loop (a magnetic loop L2 in FIG. 11), the magnetism-collection member 17→the additional core 15→the antenna core 11→the additional core 16→the magnetism-collection member 18→the antimagnetic plate (41+42)→the magnetism-collection member 17, is formed, so that the antimagnetic plate (41+42) serves as a sub magnetic path, resulting in an unnecessarily large L-value. (3) The magnetic path L1 and the magnetic loop L2 cause an eddy current to be generated in the antimagnetic plate (41+42).

Here, to prevent the magnetic path and/or the magnetic loop, it may be conceived not to lay the magnetism-collection members 17 and 18 over the antimagnetic plate (41+42). With this configuration, the areas of the magnetism-collection members 17 and 18 and the area of the antimagnetic plate (41+42) cannot be widened simultaneously. For this reason, although the effect obtainable from the fact that the magnetism-collection members 17 and 18 are offset in the thickness direction from the antimagnetic plate (41+42) can not be observed sufficiently.

Accordingly, the antimagnetic plate (41+42) is divided into two bodies: one is the antimagnetic plate 41 that is laid over the magnetism-collection member 17 when viewed from above; and the other is the antimagnetic plate 42 that is laid over the magnetism-collection member 18 when viewed from above. The antimagnetic plates 41 and 42 thus divided are divided magnetically, so that the magnetic path L1 and the magnetic loop L2 are cut off, and the creation of these unnecessary magnetic path L1 and magnetic loop L2 is prevented.

The two-body structure of the antimagnetic plates does not cause the reception performance to be lowered down by the magnetic loop or the like, and allows the areas of the magnetism-collection members 17 and 18 and the areas of the antimagnetic plates 41 and 42 to be widened simultaneously. Accordingly, the performance of both the members and the plates can be enhanced simultaneously.

This effect is also obtainable in such an ordinary antenna as the antenna core 11 of this embodiment. Specifically, in a case where the antenna core 11 is laid over the antimagnetic plate when viewed from above, the antimagnetic plate (41+42) may be divided into two separate bodies, the antimagnetic plates 41 and 42, along two straight lines D each of which is orthogonal to a straight line C connecting the two end portions of the antenna core 11 as shown in FIG. 12 (note that, the dividing line is not limited to the straight line D as long as the dividing line intersects the straight line C connecting the two end portions of the antenna core 11).

Modified Example 1

The radio-controlled timepiece 100 of this embodiment is what is known as a "combination timepiece" in which analog display (hands) and digital display (LCD) are combined together. Accordingly, the timepiece 100 includes a liquid crystal panel and the liquid-crystal-panel supporting frame 32, and the liquid-crystal-panel supporting frame 32 is used as a magnetism-collection-member supporting member and as a pressing member. However, an analog timepiece, i.e., a timepiece provided with no liquid-crystal panel but with an analog display (hands) only, is not provided with a liquid-crystal-panel supporting frame 32, either.

In this case, as the magnetism-collection-member supporting member and as the pressing member the liquid-crystal-panel supporting frame 32 is replaced with a calendar supporting frame 33 and the protrusions 33*b* (protrusions for pressing) as the pressing members as shown in FIG. 13(*a*), which is a sectional diagram corresponding to FIG. 9. The calendar supporting frame 33 supports a calendar displaying member that displays calendar information and the like. The protrusions 33*b* are formed on the calendar supporting frame 33. Each protrusion 33*b* can press the magnetism-collection member 18 (or 17) towards the additional cores 16 (or 17). Alternatively, as shown in FIG. 13(*b*), the liquid-crystal-panel supporting frame 32 may be replaced with the main plate 31, and protrusions 31g (protrusions for pressing) formed on the main plate 31 may be used as a pressing members. Each protrusion 31g can press the magnetism-collection member 18 (or 17) towards the additional cores 16 (or 17).

In Modified Example 1 shown in FIG. 13(*a*), the magnetism-collection members 17 and 18 are set in the calendar supporting frame 33 with a similar configuration to that of the embodiment shown in FIGS. 7(*a*) and (*b*). Then, the calendar supporting frame 33 that supports the magnetism-collection members 17 and 18 is set in the main plate 31. Accordingly, the magnetism-collection member 17, the additional core 15, the antenna core 11, the additional core 16, and the magnetism-collection member 18 are magnetically connected together to form a larger, functionally-integrated, antenna-core body, which has an appearance of an integrated unit.

With this configuration of Modified Example 1, the effect similar to that obtainable in the combination timepiece of the above-described embodiment is also obtainable even in an analog display timepiece.

In the configuration shown in FIG. 13(*a*), the calendar supporting frame 33 must be made of a non-conductive and non-magnetic material. In addition, a date plate 80 (an annular plate that displays the date), which is the calendar displaying member, must be made also of a non-conductive and non-magnetic material. It is because the date plate 80 is laid over the antenna core 11, the additional core 16, and the magnetism-collection member 18 when viewed from above. Reference numeral 81 in FIG. 13 denotes a date-plate pressing member that presses the date plate 80.

As described above, FIG. 13 shows a radio-controlled timepiece of the embodiment in which the calendar supporting frame 33 or the main plate 31 is used as the magnetism-collection-member supporting member and as the pressing member. Even the modified example of the embodiment can have the same advantages and effects that are obtainable by the radio-controlled timepiece 100 of the above-described embodiment where the liquid-crystal-panel supporting frame 32 is used as the magnetism-collection-member supporting member and as the pressing member.

Note that the calendar displaying member is not limited to the above-described date plate 80. Alternatively, the calendar displaying member may be a plate displaying the day of the week, or members to display other sorts of calendar information (such as the month, the year, or the lunar age).

In addition, the information to be displayed is not limited to calendar information. Alternatively, in a case where the present invention is applied to an analog world timepiece, information on various cities (regions) of the world (such as the names of the cities, or the names of the regions) may be displayed, instead.

For example, FIG. 14 is a plan view of Modified Example 1 in which the present invention is applied to the analog world timepiece. In FIG. 14, the date plate 80 displays the date of calendar information. A city displaying plate 82 is provided concentrically with the date plate 80 and at the inner side of the date plate 80. The names of various cities (regions) of the world are printed, in abbreviated forms, on the city displaying plate 82. The city displaying plate 82 informs the user which of the cities (regions) is selected to show the current time. Both the date plate 80 and the city displaying plate 82 are held by the calendar supporting frame 33.

The magnetism-collection members 17 and 18 are supported by the calendar supporting frame 33 with a similar configuration to that shown in FIGS. 7(*a*) and (*b*) where the magnetism-collection members 17 and 18 are supported by the liquid-crystal-panel supporting frame 32.

As shown in FIG. 14, the date plate 80 and the city displaying plate 82 are laid over the antenna core 11, the additional cores 15 and 16, and the magnetism-collection members 17 and 18 when viewed from above. Accordingly, the date plate 80 and the city displaying plate 82 have to be made of a non-conductive and non-magnetic material so as not to obstruct the reception of the standard signal.

In addition the above-described embodiment and modified example describe a radio-controlled timepiece of an embodiment where the liquid-crystal-panel supporting frame 32 or calendar supporting frame 33 is used as a magnetism-collection-member supporting member and pressing members. In the radio-wave timepiece of the present invention, however, the liquid-crystal panel supporting frame 32 and the calendar supporting frame 33 may serve as pressing members but may not have to serve as magnetism-collection-member supporting member.

Modified Example 2

In the radio-controlled timepiece 100 of the above-described embodiment, not only the additional cores 15 and 16 but also the magnetism-collection members 17 and 18 are added to form a larger antenna-core body. However, an antenna-core body may be formed without the magnetism-collection members 17 and 18. In the alternative configuration, only the additional cores 15 and 16 are provided so as to be in contact respectively with the extension portions 11b and 11c of the antenna core 11.

FIGS. 15(*a*) to (*c*) are perspective diagrams illustrating various antenna-core bodies. Each of the antenna-core bodies does not include the magnetism-collection members 17 and 18, and is formed as a single body in which only the additional cores 15 and 16 are integrated with the antenna core 11 by bringing only the additional cores 15 and 16 into contact respectively with the extension portions 11b and 11c of the antenna core 11. These antenna-core bodies are variations of the embodiment of the present invention, and each of these embodiments can further enhance the reception sensitivity by forming a larger antenna-core body.

In addition, the additional cores 15 and 16 use up not towards the back lid made of metal but towards the windshield glass (in the Z-direction) that allows the standard signal to pass therethrough more easily. Accordingly the single-body antenna-core body including the additional cores 15 and 16 and the antenna core 11 is placed with its open side facing the windshield glass. Consequently, the reception sensitivity can be enhanced further.

In addition, the antenna core 11 and the additional cores 15 and 16 are formed as independent bodies before being assembled together. Accordingly, changing, in various ways, a contact angle made by these cores, contact positions of these cores, and the like allows the shape of the integrated antenna-core body to be formed freely to a certain degree. Therefore, the degree of freedom for the appearance of the antenna-core body can be higher than that in the conventional case where the antenna-core body is formed into a desired shape by bending the antenna core that has been originally provided as a single, integrated body.

Accordingly, by bringing the additional cores 15 and 16 into contact with the antenna core 11 so that the additional cores 15 and 16 can rise up in the thickness direction of the timepiece 100, the antenna-core body, as a single entity, can be formed so as to have a three-dimensionally expanding shape. This antenna-core body can further enhance the reception sensitivity compared to that obtainable in the conventional case where only an antenna core is simply increased in size within a single plane. Concurrently, even within the limited space in the case 50 of the timepiece 100, the degree of freedom for the placement of the antenna 100 is higher than those in conventional cases.

In addition, the antenna core 11 is supported by the main plate 31 and the wheel-train bearing 20 within a face of the main plate 31. The additional cores 15 and 16 are supported respectively by the support holes 31*b* and 31*c* of the main plate 31 that serves also as the guide portion 33 in such a way as to rise up in the thickness direction of the timepiece 100. The additional cores 15 and 16 are biased so as to bring the one faces thereof into contact respectively with the extension portions 11*b* and 11*c* of the antenna core 11. Accordingly, assembling the components into the antenna-core body is easier than in the case where the components are assembled into the antenna-core body without the main plate 31, the guide member 33, or the liquid-crystal-panel supporting frame 32.

It is useful that, when each of the antenna core 11 and the magnetism-collection members 17 and 18 are made of an amorphous material, a laminate of plural layers of the amorphous material is used so as to have a certain thickness to ensure a stable performance.

In addition, as being biased by the pressing members, the additional cores 15 and 16 are prevented from having the reception performance of the antenna 10 to be affected even each having an undulated surface. Accordingly, it is not necessary to carry out a process of, for example, polishing the surfaces of the additional cores 15 and 16, and thus the manufacturing cost can be low.

In addition, the extension portions 11*b* and 11*c* are formed respectively on the two end sides of the antenna core 11. The additional cores 15 and 16 are biased towards and brought into contact with their corresponding extension portions 11*b* and 11*c* that are formed, respectively, on the two end sides of the antenna core 11. Accordingly, making the additional cores 15 and 16 correspond respectively to the extension portions 11*b* and 11*c* allows the reception of the standard signal to be balanced appropriately.

In addition, the antenna core 11 is made of an amorphous material, that is, a brittle material, and thus has difficulty in being bent due to its physical properties. The radio-controlled timepiece 100 of this embodiment, however, can obtain the effect similar to that obtainable by bending the antenna core 11. Accordingly, the antenna 11 can enhance its own practical utility.

The antenna 10 most easily receives the standard signal at the leading-end portions of the additional cores 15 and 16. In the radio-controlled timepiece 100 of this embodiment, the leading-end of the additional cores 15 and 16 are directed towards the windshield glass. Accordingly, each of the leading ends is positioned quite closely to the windshield glass and is formed to be a flat surface with a broader area. Consequently, the leading-ends easily receive the standard signal that enters through the windshield glass.

Accordingly, even if the case 50, the back lid, and other portions of the timepiece 100 except for the windshield glass are made of a metal to improve the external appearance of the timepiece 100, the antenna 10 can be prevented from having a less performance to receive the standard signal.

The invention claimed is:

1. A radio-controlled timepiece, comprising:

an antenna core made of a magnetic material and formed as a single integrated body including a coiled portion wound with a coil and an extension portion that is located closer to an end portion than the coiled portion is;

an additional core made of a magnetic material;

a timepiece substrate made of a non-magnetic material;

a guide member made of a non-magnetic material, the guide member being separate from and non-integrated with the additional core; and a pressing member made of a non-magnetic material, wherein:

the timepiece substrate includes an antenna supporting portion supporting the antenna core substantially within a plane of the timepiece substrate, the guide member includes an additional core-supporting portion supporting the additional core so that the additional core rises up in the thickness direction of the timepiece, and the pressing member biases the additional core towards the extension portion of the antenna core so that a first end face of the additional core comes into contact with the extension portion of the antenna core.

2. The radio-controlled timepiece according to claim 1, wherein the pressing member includes a lower pressing member located at the antenna core and an upper pressing member located at the additional core.

3. The radio-controlled timepiece according to claim 1, wherein the extension portion is one of two extension portions are formed respectively on two end portions of the antenna core, and the additional core is one of two additional cores biased respectively towards and are thus in contact respectively with the extension portions formed respectively on the two end portions of the antenna core.

4. The radio-controlled timepiece according to claim 1, wherein the antenna core is made of an amorphous material.

5. The radio-controlled timepiece according to claim 1, comprising:

a magnetism-collection member made of a magnetic material; and a magnetism-collection member-supporting member supporting the magnetism-collection member, wherein the magnetism-collection member-supporting member supports the magnetism-collection member so that the magnetism-collection member is positioned between the pressing member and a second end face of the additional core and is in contact with the second end face of the additional core.

6. The radio-controlled timepiece according to claim 5, wherein the magnetism-collection member-supporting member is formed integrally with the pressing member, and a protrusion for pressing is formed, as the pressing member, on the magnetism-collection member-supporting member.

7. The radio-controlled timepiece according to claim 5, further comprising an antimagnetic plate disposed in a space between the antenna core and the magnetism-collection member in the thickness direction, the antimagnetic plate being configured to block or reduce an influence of an external magnetic field on a motor.

8. The radio-controlled timepiece according to of claim 7, wherein the magnetism-collection member is laid at least partially over the antimagnetic plate when viewed from above.

9. The radio-controlled timepiece according to claim 8, wherein the magnetism-collection member is one of a plurality of magnetism-collection members disposed respectively at both ends of the antenna core, and at least a part of each of the magnetism-collection members is laid over the antimagnetic plate when viewed from above.

10. The radio-controlled timepiece according to claim 9, wherein the antimagnetic plate includes: a first antimagnetic plate, a part of the first antimagnetic plate being laid over a first one of the magnetism-collection members when viewed from above; and a second antimagnetic plate, a part of is the second antimagneticate being laid over a second one of the magnetism-collection members when viewed from above, and the first antimagnetic plate and the second antimagnetic plate are disposed so as to be magnetically separated from each other.

11. The radio-controlled timepiece according to claim 1, further comprising a liquid-crystal-panel supporting frame made of a non-magnetic material and supporting a liquid crystal panel, wherein the liquid-crystal-panel supporting frame serves also as the pressing member.

12. The radio-controlled timepiece according to claim 1, further comprising a calendar supporting frame to hold a calendar displaying member made of a non-magnetic material and configured to display a calendar information, wherein the calendar supporting frame serves also as the pressing member.

13. A method of assembling a radio-controlled timepiece, the method comprising:

supporting an antenna core on an antenna supporting portion to substantially within a plane of a timepiece substrate, the antenna supporting portion being formed in the timepiece substrate made of a non-magnetic material, the antenna core being made of a magnetic material and being formed as a single integrated body including a coiled portion wound with a coil and an extension portion located closer to an end portion than the coiled portion is;

supporting an additional core made of a magnetic material on an additional-core supporting portion so that the additional core rises up in the thickness direction of the timepiece, the additional-core supporting portion formed in a guide member made of a non-magnetic material, the guide member being separate from and non-integrated with the additional core; and biasing the additional core towards the antenna core by a pressing member made of a non-magnetic material so that one end face of the additional core comes into contact with the extension portion of the antenna core.

14. The method of assembling a radio-controlled timepiece according to claim 13, wherein the pressing member includes a lower pressing member located at the antenna core and an upper pressing member located at the additional core.

15. The method of assembling a radio-controlled timepiece according to claim 13, further comprising:

supporting a magnetism-collection member made of a magnetic material on a magnetism-collection member-supporting member; and then setting the magnetism-collection member-supporting member in such a position that the magnetism-collection member is positioned between the pressing member and the other end face of the additional core and is in contact with the other end face of the additional core.

16. The method of assembling a radio-controlled timepiece according to claim 15, wherein the magnetism-collection member-supporting member is formed integrally with the pressing member, and a protrusion for pressing is formed, as the pressing member, on the magnetism-collection member-supporting member.

17. The method of assembling a radio-controlled timepiece according to claim 13, wherein the extension portion is one of two extension portions formed respectively on the two end portions of the antenna core, and the additional core is one of two additional cores biased respectively towards and are thus in contact respectively with the extension portions formed respectively on the two end portions of the antenna core.

18. The method of assembling a radio-controlled timepiece according to claim 13, wherein the antenna core is made of an amorphous material.

19. The method of assembling a radio-controlled timepiece according to claim 13, wherein the biasing of the additional core towards the antenna, core comprises using a liquid-crystal-panel supporting frame to serve as the pressing member, the liquid-crystal-panel supporting frame being made of a non-magnetic material and being arranged to hold a liquid crystal panel.

20. The method of assembling a radio-controlled timepiece according to claim 13, wherein the biasing of the additional core towards the antenna core comprises using a calendar supporting frame to serve as the pressing member, the calendar supporting frame being arranged to hold a calendar displaying member made of a non-magnetic material and configured to display calendar information.

* * * * *

UNITED STATES PATENT AND TRADEMARK OFFICE

CERTIFICATE OF CORRECTION

PATENT NO. : 8,345,514 B2
APPLICATION NO. : 12/449544
DATED : January 1, 2013
INVENTOR(S) : Tatsuo Sumida It is certified that error appears in the above-identified patent and that said Letters Patent is hereby corrected as shown below:

In the Claims:

In claim 3, lines 3-4, change "the extension portion is one of two extension portions are formed respectively on two end portions of the antenna" to --the extension portion is one of two extension portions formed respectively on two end portions of the antenna--;

In claim 10, line 7, change "the second antimagneticate being laid over a second one" to --the second antimagnetic being laid over a second one--;

In claim 13, lines 3-5, change "supporting an antenna core on an antenna supporting portion to substantially within a plane of a timepiece substrate, the antenna supporting portion being formed in" to --supporting an antenna core on an antenna supporting portion substantially within a plane of a timepiece substrate, the antenna supporting portion being formed in--; and In claim 19, line 3, change "the biasing of the additional core towards the antenna, core" to --the biasing of the additional core towards the antenna core--.

Signed and Sealed this
Fourth Day of June, 2013

Teresa Stanek Rea

Teresa Stanek Rea
*Acting Director of the United States Patent and Trademark Office*

UNITED STATES PATENT AND TRADEMARK OFFICE

CERTIFICATE OF CORRECTION

PATENT NO. : 8,345,514 B2
APPLICATION NO. : 12/449544
DATED : January 1, 2013
INVENTOR(S) : Tatsuo Sumida It is certified that error appears in the above-identified patent and that said Letters Patent is hereby corrected as shown below:

In the Claims:

Column 20, lines 27-28 (claim 3, lines 3-4) change "the extension portion is one of two extension portions are formed respectively on two end portions of the antenna" to --the extension portion is one of two extension portions formed respectively on two end portions of the antenna--;

Column 21, line 15 (claim 10, line 7) change "the second antimagneticate being laid over a second one" to --the second antimagnetic being laid over a second one--;

Column 21, lines 36-38 (claim 13, lines 3-5) change "supporting an antenna core on an antenna supporting portion to substantially within a plane of a timepiece substrate, the antenna supporting portion being formed in" to --supporting an antenna core on an antenna supporting portion substantially within a plane of a timepiece substrate, the antenna supporting portion being formed in--; and Column 22, line 39 (claim 19, line 3) change "the biasing of the additional core towards the antenna, core" to --the biasing of the additional core towards the antenna core--.

This certificate supersedes the Certificate of Correction issued June 4, 2013.

Signed and Sealed this
Second Day of July, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,345,514 B2
APPLICATION NO. : 12/449544
DATED : January 1, 2013
INVENTOR(S) : Tatsuo Sumida It is certified that error appears in the above-identified patent and that said Letters Patent is hereby corrected as shown below:

In the Claims:

Column 20, lines 27-28 (claim 3, lines 3-4) change "the extension portion is one of two extension portions are formed respectively on two end portions of the antenna" to --the extension portion is one of two extension portions formed respectively on two end portions of the antenna--;

Column 21, line 15 (claim 10, line 7) change "the second antimagneticate being laid over a second one" to --the second antimagnetic plate being laid over a second one--;

Column 21, lines 36-38 (claim 13, lines 3-5) change "supporting an antenna core on an antenna supporting portion to substantially within a plane of a timepiece substrate, the antenna supporting portion being formed in" to --supporting an antenna core on an antenna supporting portion substantially within a plane of a timepiece substrate, the antenna supporting portion being formed in--; and Column 22, line 39 (claim 19, line 3) change "the biasing of the additional core towards the antenna, core" to --the biasing of the additional core towards the antenna core--.

This certificate supersedes the Certificates of Correction issued June 4, 2013 and July 2, 2013.

Signed and Sealed this
Twentieth Day of August, 2013

Teresa Stanek Rea
*Acting Director of the United States Patent and Trademark Office*